US010464084B2

(12) United States Patent
Nolte et al.

(10) Patent No.: US 10,464,084 B2
(45) **Date of Patent: *Nov. 5, 2019**

(54) ELECTRODE ASSEMBLY FOR AN ELECTROSTATIC ATOMIZER

(71) Applicant: Dürr Systems GmbH, Bietigheim-Bissingen (DE)

(72) Inventors: Hans-Jürgen Nolte, Besigheim (DE); Andreas Fischer, Ludwigsburg (DE); Peter Marquardt, Steinheim (DE); Jürgen Berkowitsch, Neuhausen (DE); Joachim Schneider, Tauberbischofsheim (DE)

(73) Assignee: DÜRR SYSTEMS GMBH, Bietigheim-Bissingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/813,390

(22) Filed: Nov. 15, 2017

(65) Prior Publication Data

US 2018/0141062 A1 May 24, 2018

Related U.S. Application Data

(63) Continuation of application No. 13/257,490, filed as application No. PCT/EP2010/001751 on Mar. 19, 2010, now Pat. No. 9,901,942.

(30) Foreign Application Priority Data

Mar. 19, 2009 (DE) ..... 10 2009 013979

(51) Int. Cl.
*B05B 5/053* (2006.01)
*B05B 5/00* (2006.01)
(Continued)

(52) U.S. Cl.
CPC ..... *B05B 5/0533* (2013.01); *B05B 5/005* (2013.01); *B05B 5/0422* (2013.01);
(Continued)

(58) Field of Classification Search
CPC ..... B05B 5/0533; B05B 5/0536; B05B 16/95; B05B 5/005; B05B 5/0422;
(Continued)

(56) References Cited

U.S. PATENT DOCUMENTS 4,377,603 A 3/1983 Itoh et al.
4,572,438 A * 2/1986 Traylor ..... B05B 5/0536 239/600
(Continued)

FOREIGN PATENT DOCUMENTS

DE 2750372 A1 5/1978
DE 3609240 A1 9/1987
(Continued)

OTHER PUBLICATIONS

Examination Report from Intellectual Property India for Application No. 7535/CHENP/2011 dated Jun. 26, 2018 (6 pages, with English translation).
(Continued)

*Primary Examiner* — Chee-Chong Lee
*Assistant Examiner* — Steven M Cernoch
(74) *Attorney, Agent, or Firm* — Bejin Bieneman PLC

(57) ABSTRACT

Various exemplary illustrations of an electrode assembly for an electrostatic atomizer, for example for a rotation atomizer, and exemplary methods of making and/or using the same, are disclosed. An exemplary electrode assembly may not include an electrode holder arrangement for holding at least one electrode creating an electrostatic field about a symmetrical axis, wherein there is dielectric material for
(Continued)

influencing a discharge current component extending in the direction of the symmetrical axis.

18 Claims, 15 Drawing Sheets

(51) Int. Cl.

| | |
|---|---|
| ***B05B 5/04*** | (2006.01) |
| ***B05B 13/02*** | (2006.01) |
| ***B05B 16/00*** | (2018.01) |
| ***B05B 5/08*** | (2006.01) |
| ***B05B 13/04*** | (2006.01) |

(52) U.S. Cl.
CPC ..... *B05B 5/0536* (2013.01); *B05B 13/0271* (2013.01); *B05B 16/95* (2018.02); *B05B 5/0407* (2013.01); *B05B 5/0426* (2013.01); *B05B 5/084* (2013.01); *B05B 5/087* (2013.01); *B05B 13/0431* (2013.01); *B05B 13/0452* (2013.01); *B05B 13/0457* (2013.01); *B05B 16/00* (2018.02)

(58) Field of Classification Search
CPC . B05B 13/0271; B05B 13/0457; B05B 16/00; B05B 5/0426; B05B 5/087; B05B 5/407; B05B 13/0431; B05B 13/0452; B05B 5/084
See application file for complete search history.

(56) References Cited

U.S. PATENT DOCUMENTS

| | | | | |
|---|---|---|---|---|
| 4,589,597 | A | 5/1986 | Robisch et al. | |
| 5,044,564 | A | 9/1991 | Sickles | |
| 5,163,625 | A | 11/1992 | Takayama et al. | |
| 5,397,063 | A | 3/1995 | Weinstein | |
| 5,622,563 | A * | 4/1997 | Howe | B05B 3/1064 118/620 |
| 5,704,977 | A | 1/1998 | Baumann et al. | |
| 5,765,761 | A * | 6/1998 | Law | B05B 5/03 239/690.1 |
| 5,775,598 | A | 7/1998 | Takayama et al. | |
| 5,816,508 | A | 10/1998 | Hollstein | |
| 5,865,380 | A | 2/1999 | Kazama et al. | |
| 6,105,886 | A | 8/2000 | Hollstein | |
| 6,164,561 | A | 12/2000 | Yoshida et al. | |
| 6,565,021 | B2 | 5/2003 | Borner et al. | |
| 6,896,735 | B2 | 5/2005 | Giuliano et al. | |
| 7,070,130 | B1 | 7/2006 | Minko | |
| 7,552,882 | B2 | 6/2009 | Matsumoto et al. | |
| 7,762,481 | B2 * | 7/2010 | Clifford | B05B 5/1633 239/706 |
| 7,793,869 | B2 | 9/2010 | Mather | |
| 7,797,878 | B2 | 9/2010 | Schuster | |
| 7,815,132 | B2 * | 10/2010 | Baltz | B05B 5/03 239/345 |
| 7,837,136 | B2 | 11/2010 | Yamada et al. | |
| 7,913,938 | B2 * | 3/2011 | Cooper | B05B 5/03 239/690 |
| 8,057,197 | B2 | 11/2011 | Fulkerson | |
| 8,333,570 | B2 | 12/2012 | Fulkerson | |
| 8,430,340 | B2 * | 4/2013 | Herre | B05B 3/1014 239/225.1 |
| 8,678,777 | B2 | 3/2014 | Fulkerson | |
| 8,807,464 | B2 | 8/2014 | Mather | |
| 8,827,191 | B2 | 9/2014 | Mather | |
| 9,901,942 | B2 * | 2/2018 | Nolte | B05B 5/005 |
| 2002/0096582 | A1 | 7/2002 | Edelhauser | |
| 2004/0069877 | A1 | 4/2004 | Schaupp | |
| 2004/0255849 | A1 | 12/2004 | Giuliano et al. | |
| 2005/0023369 | A1 | 2/2005 | Schaupp | |
| 2005/0115496 | A1 | 6/2005 | Shutic | |
| 2005/0126476 | A1 | 6/2005 | Shutic | |
| 2005/0158187 | A1 | 7/2005 | Fulkerson | |
| 2006/0124782 | A1 | 6/2006 | Matsumoto et al. | |
| 2006/0144963 | A1 | 7/2006 | Fulkerson | |
| 2007/0039546 | A1 | 2/2007 | Amari et al. | |
| 2007/0290080 | A1 * | 12/2007 | Okumoto | A61M 15/02 239/690 |
| 2010/0024776 | A1 * | 2/2010 | Frick | F02M 51/0603 123/478 |
| 2010/0230511 | A1 | 9/2010 | Umezawa et al. | |
| 2012/0031329 | A1 | 2/2012 | Sakakibara et al. | |
| 2014/0169990 | A1 | 6/2014 | Fulkerson | |
| 2014/0373778 | A1 | 12/2014 | Fulkerson | |

FOREIGN PATENT DOCUMENTS

| | | | |
|---|---|---|---|
| DE | 3709508 | A1 | 10/1988 |
| DE | 10202711 | A1 | 7/2003 |
| DE | 10205593 | A1 | 8/2003 |
| DE | 69623768 | T2 | 8/2003 |
| DE | 69824908 | T2 | 8/2005 |
| DE | 102005000983 | A1 | 7/2006 |
| DE | 202006015697 | U1 | 3/2007 |
| EP | 1224981 | A2 | 7/2002 |
| EP | 1334775 | A1 | 8/2003 |
| EP | 1362640 | A1 | 11/2003 |
| EP | 1634651 | A1 | 3/2006 |
| JP | H081047 | A | 1/1996 |
| JP | H08-108114 | A | 4/1996 |
| JP | H08-257441 | A | 10/1996 |
| JP | H11-262699 | A | 9/1999 |
| JP | 2001113207 | A | 4/2001 |
| JP | 2004148240 | A | 5/2004 |
| JP | 2008080240 | A | 4/2008 |
| JP | 2008-142662 | A | 6/2008 |
| JP | 4093282 | B1 | 6/2008 |
| JP | 2009039684 | A | 2/2009 |
| RU | 1806020 | | 3/1993 |
| RU | 1806020 | C | 3/1993 |
| RU | 2050427 | C1 | 12/1995 |
| RU | 2163515 | C1 | 2/2001 |
| SU | 1547855 | A1 | 3/1990 |
| WO | 2007010873 | A1 | 1/2007 |
| WO | 2007131660 | A1 | 11/2007 |
| WO | 2008096453 | A1 | 8/2008 |
| WO | 2008150790 | A1 | 12/2008 |
| WO | 2009149950 | A1 | 12/2009 |

OTHER PUBLICATIONS

Notice of Opposition for EP Patent No. EP2408568 dated Sep. 28, 2017 (6 pages).
Notification of Opposition and Written Opposition relating to JP2015-700233 mailed Dec. 7, 2015 (114 pages).
International Search Report and Written Opinion for PCT/EP2010/001751 dated May 26, 2010 (28 pages; with English translation).

* cited by examiner 1203
1207
1205
1201

1211
1209
1213
1205
1201

1209
1215
1217
1201

1221
1209
1219
1217

1225
1209
1201
1205
1223

1229
1225
1227
1025
1230
1231

1235
1233

ELECTRODE ASSEMBLY FOR AN ELECTROSTATIC ATOMIZER

CROSS-REFERENCE TO RELATED APPLICATIONS

This application is a continuation of, and claims priority to, U.S. patent application Ser. No. 13/257,490, filed on Sep. 19, 2011, which is a national stage of, and claims priority to, Patent Cooperation Treaty Application No. PCT/EP2010/001751, filed on Mar. 19, 2010, which application claims priority to German Application No. DE 10 2009 013979.6, filed on Mar. 19, 2009, which applications are hereby incorporated herein by reference in their entireties.

The present disclosure relates to the area of coating of workpieces by means of electrostatically supported atomization, in particular by means of electrostatic rotary atomization.

To coat workpieces such as vehicle bodies it is possible to use electrostatic atomizers, in particular electrostatic rotary atomizers, with so-called external charging for which a spray jet is subjected to an electrostatic field generated by external electrodes. The droplets of paint are thus charged by attachment of ions and transported to the workpiece, being for example earthed, as described, for example, in the publications DE 10202711 A1 and EP 1 362 640 B1.

The publications US 2007/0039546 A1, U.S. Pat. Nos. 5,163,625 A, 5,044,564 A, DE 102 05 593 A1, DE 37 09 508 A1, DE 36 09 240 A1 and DE 10 2005 000 983 A1 disclose further electrostatic coating devices.

One disadvantage of the known external charging concepts is that the external electrodes required to generate the electrostatic field make it more difficult to coat small areas and confined spaces such as those found inside workpieces or in the inner areas of a vehicle door or in the entry areas of a vehicle body, or coating of tightly connected individual parts on an article carrier, in particular attachment parts with small distance such as bumpers, because of their size.

Furthermore, it is generally necessary to have an expensive and extensive, usually complex, potential isolation, in particular for use of conductive paints, for example water-based paints or low-resistance solvent-based paints, in particular those with a high solids content, due to compact construction. Furthermore, such electrostatic atomizers are typically difficult to clean since the usually used six to eight external electrode fingers, which form the external electrodes, must be individually cleaned or replaced. Furthermore, for a direct charging application with a compact construction in which not yet atomized paint is placed directly under a high-voltage potential, it is necessary to have an expensive and extensive, usually complex, potential isolation, in particular for use of conductive paints, for example water-based paints.

It is the task of the present disclosure to provide exemplary illustrations of an external charging concept for an electrostatic atomizer which allows both internal coating as well as external coating of workpieces, in particular of vehicle bodies and attachment parts, such as bumpers, while also permitting relatively simple cleaning of the electrostatic atomizer.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain feature may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
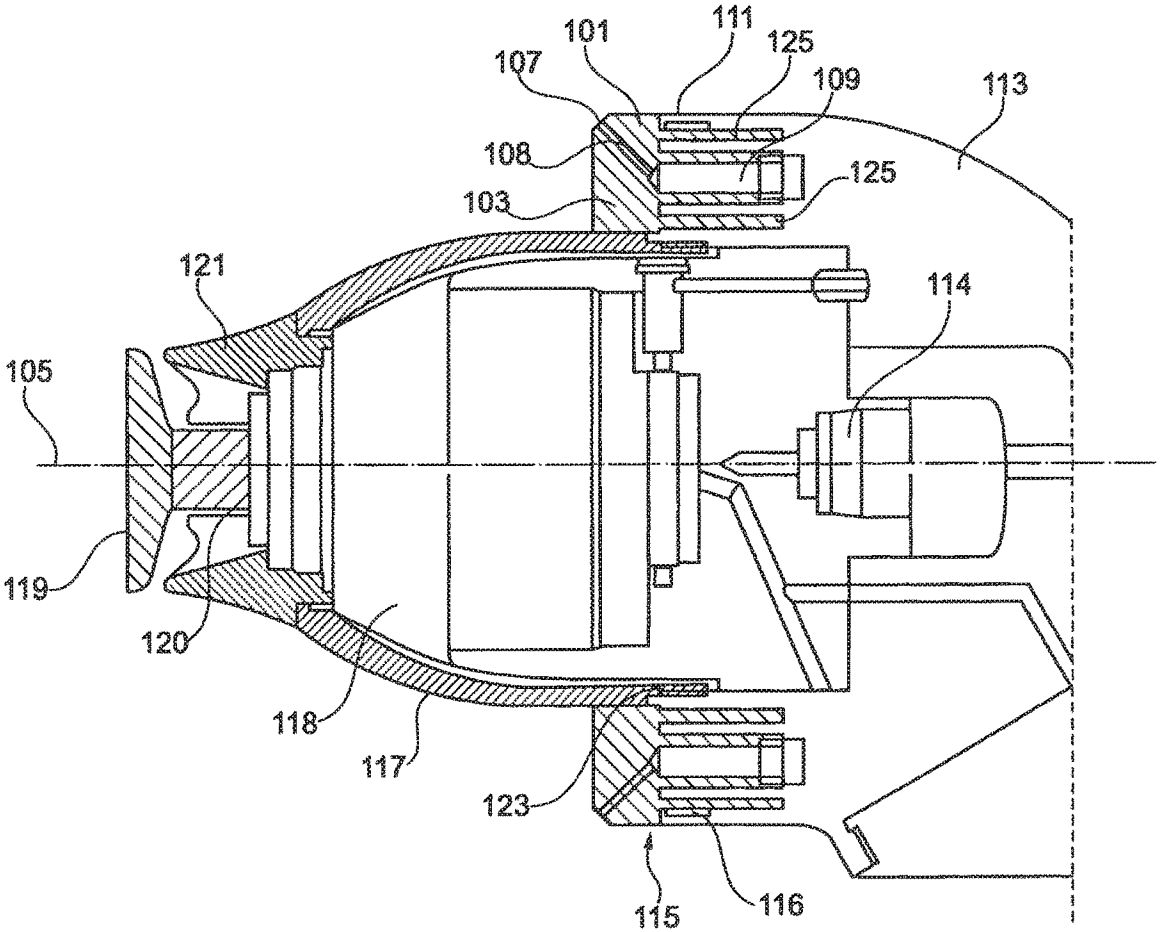
FIG. 1 an electrostatic rotary atomizer, according to an exemplary illustration.

The exemplary illustrations are based on the concept that an efficient external charging concept which allows both internal/detail coating (that is internal coating and/or detail coating) and also external coating of workpieces can be realized by an electrode assembly with, for example, an electrode ring. The electrodes of the electrode assembly are provided to generate an electrostatic field which contributes to creating discharge currents flowing at least over a housing surface. In one exemplary illustration, a discharge current component of a discharge current extending in the direction of the axis of symmetry, that is to the axis of symmetry, for example in the direction of an axis of symmetry of the electrode assembly or the electrode ring or in the direction of a spray element arranged around the axis of symmetry, for example a bell cup, or a spray jet axis, or in the direction of a robot hand axis (robot wrist axis) may be influenced in a specific dielectrically manner, in particular dampened. In particular, both directions of the respective axis can be taken into account.

The exemplary illustrations in particular allows minimization or avoidance of unwanted or parasitic discharges, whereby it is advantageous that increased charging of the coating agent or the spray jet can be achieved. In this way the dimensions of the electrostatic atomizers can be reduced which simplifies reaching difficult to access parts inside the vehicle body. At the same time it is possible to arrange the electrodes in such a way that the same electrostatic atomizer can be used both for internal painting as well as for external painting. It is furthermore possible, by means of a modular formation of the electrostatic atomizer, that for example a respectively to be used electrode assembly connectable in a modular fashion to the electrostatic atomizer (e.g., detachable for example by means of a thread) can be adapted for the respective purpose, in such a way that for example an electrode assembly with smaller dimensions can be used for internal painting and an electrode assembly with larger dimensions can be used for external painting. Furthermore, it is possible to provide for telescopic movable electrodes which can be pushed out for external painting, for example, using compressed air. Furthermore, it is possible for the electrode assembly to have electrodes of different lengths and/or angles of inclination relative to the axis of symmetry.

According to one exemplary illustration, an assembly for one or more electrodes or an electrode assembly for an electrostatic atomizer is provided, for example for an electrostatic rotary atomizer, with an electrode holding device for holding at least one electrode generating an electrostatic field around an axis of symmetry, wherein, for example, a dielectric material can be provided, such as for influencing a discharge current component of a discharge current extending in the direction of the axis of symmetry. The electrode assembly is, in particular, designed for external charging of coating agent and is particularly suitable for external charging of coating agent in internal/detail coating and/or external coating. The electrode assembly can have one or more electrodes or be formed to receive one or more electrodes.

It may be advantageous for the electrode assembly and/or the electrode holding device and/or the dielectric material to have a central axis. The axis of symmetry may correspond to the central axis of the electrode assembly and/or the electrode holding device and/or the dielectric material.

The axis of symmetry can, for example, be an axis of symmetry, in particular a rotary axis, of the electrode holding device, which can, for example, be formed rotationally symmetric, in particular ring shaped. The axis of symmetry can, however, be an axis of symmetry of, for example, a rotationally symmetric electrostatic field. Furthermore, the axis of symmetry can, in the case of electrostatic rotary atomization, be established by a spray jet direction of spray jet emitted by a spray element, or by an axis of a turbine shaft which drives the spray element, such as a bell cup. The above-mentioned axes of symmetry can, in particular in the case of rotary atomizers, also coincide as a common axis of symmetry.

The discharge current component extending in the direction of the axis of symmetry can, in particular, spread at any arbitrary angle towards the axis of symmetry and, for example, directly in the direction of the axis of symmetry, for example normal to it or at another angle which is less than 90°, or along a housing surface or along a path prescribed by the electrical field lines or can spread or extend along any desired path towards the axis of symmetry.

The dielectric material can, for example, be an insulating material with a dielectric constant which differs from that of air or is greater than that. The dielectric material may be provided to influence the discharge current component extending in the direction of the axis of symmetry and is arranged, in particular, to insulate earthed components or those which have a low potential applied to them (for example the spray element (bell cup), drive turbine, support device, hand (wrist) axis, etc.), whereby the current flow can be altered and/or minimized and/or interrupted in a specific manner. Through insulation of, for example, the earthed components, the flow of a current will be altered or prevented, whereby also wear can be reduced, the current flow over the atomized paint will, however, be influenced positively. Through use of the dielectric material, for example, a propagation path of the discharge current will be extended in the direction of the axis of symmetry, whereby an extension of a discharge path will be achieved in such a way that the electrode assembly can also be used for internal painting. The dielectric material is, in particular, provided on at least one electrode in such a way that insulation to the rear is achieved during operation of the atomizer (for example in the direction of the hand axis or on the side of the hand axis or in the direction facing away relative to the spray element or to the side facing away relative to the spray element) and/or (radially) to the inside (for example in the direction of the drive turbine or other internal atomizer equipment) and/or to the front (for example on the spray element side or in the direction of the spray element) and/or (radially) to the outside (for example in the direction facing away relative to the drive turbine). In this way it is possible to reduce or avoid unwanted (parasitic) discharges, whereby charging of the coating agent can be increased. This exemplary illustration is furthermore particularly advantageous for use in a painting cabin, for example in a universal cabin or in a painting booth. The exemplary illustrations may, in particular, be used in a booth concept, e.g., as described in the publication WO 2007/131660A1, whose contents are attributed to the contents of this publication and are expressly incorporated herein by reference in their entirety.

According to one exemplary illustration, the dielectric material is, for example, arranged or formed asymmetrically relative to an electrode held or holdable by the electrode holding device, such that the discharge current component extending in the direction of the axis of symmetry can be influenced in a specific manner. The dielectric material can, for example, be bulged in the direction of the axis of symmetry, whereby, advantageously, direction-dependent influencing of the discharge current component is achieved.

According to one exemplary illustration the electrode assembly comprises at least one electrode which can be coupled with the electrode holding device for generation of the electrostatic field, in particular mechanically and/or electrically. The at least one electrode can be embedded or housed or inserted into the electrode holding device at least partially or fully or except for an end of the electrode which can be roughly between 1 mm to 5 mm long, or fully or almost fully. The at least one electrode can furthermore be fully or almost fully recessed in the electrode holding device or at least one electrode receiving space. In such cases the dielectric material can, for example, be an integral component of the electrode holding device which can or does consist of a dielectric material.

In one exemplary illustration, at least one electrode and/or at least one electrode receiving space is housed in the electrode holding device.

According to an exemplary illustration, resistors with a length of about 30 mm or between about 30 mm up to 100 mm, and/or a diameter of about 8 mm or between about 6 mm and 12 mm can be embedded in the electrode holding device or in an insulating material of the electrode holding device or in the dielectric material in an insulating medium. In this way voltage flashovers can be avoided in an advantageous manner. There can be one resistor provided or a plurality of resistors.

The resistor can, for example, be a resistor element which is made out of partially conductive plastic or a semiconductor which can deliver effectively the substantially same resistance value all the time as a commercially available thick-film resistor.

The electrode assembly can have one or a plurality of, for example, cylindrical or sleeve-shaped, resistor receiving means for receiving at least one resistor. The at least one resistor receiving means can be provided with an insulating medium, for example being coated or filled. The at least one resistor can, in particular, be coated or covered by an insulating medium or embedded in an insulating medium. The resistor receiving means, in particular its receiving space, can be formed closable with a closing means made out of plastic, for example a cap, thereby making it possible to prevent material escaping from it such as liquid insulating medium. The at least one resistor and/or the at least one resistor receiving means can substantially be arranged parallel to the axis of symmetry.

The insulating medium or insulating fluid can be a lipid (oils, greases, etc.) for example. The insulating medium can be gaseous (e.g. $SF_6$), solid, liquid or fluid. It is also possible to use casting compound or suitable adhesives as an insulating medium. The insulating medium should have very good insulating properties. It is also possible to arrange or embed the parts to be insulated (e.g. the electrodes, the resistors, etc.) directly in the insulating or dielectric material.

The electrode holding device may comprises at least one, for example, cylindrical or sleeve-shaped receiving space for receiving one electrode. The electrode assembly may comprise at least one electrode and/or at least one electrode receiving space which is arranged at an angle relative to the axis of symmetry and/or extends obliquely to the outside and/or to the front. In this way the electrode and/or the electrode receiving space may advantageously not be located parallel to the axis of symmetry. According to an exemplary illustration the electrode assembly comprises at least one electrode (or at least one electrode receiving space), which can be coupled with the electrode holding device to generate the electrostatic field, for example mechanically and/or electrically, wherein there is an angle between the at least one electrode and the axis of symmetry which is greater than 0° and not greater than, e.g., less than, 90° or 180°, for example greater than about 40°, 45° or 50° and/or less than about 60°, 65°, or 70°, in particular about 55°. It is also possible that the angle has negative values of up to −90°.

The electrodes or the electrode receiving spaces can therefore, in particular, be arranged obliquely or at an angle to the axis of symmetry, for example extending to the front and/or to the outside, but also extending to the front and/or to the inside. Even extension to the outside and/or to the rear is possible.

The electrodes or the electrode receiving spaces can also substantially be arranged parallel or not parallel or skewed to the axis of symmetry. Angles of between 0° and +/−180° are possible for the arrangement not parallel to the axis of symmetry.

It is also possible that the axis of symmetry and at least one of the electrode receiving spaces and/or at least one of the electrodes extend into a fictitious common plane.

This ensures in an advantageous way that the electrode assembly with the electrode arranged in this way can be used both for internal coating and for external coating.

According to an exemplary illustration, the electrode assembly comprises at least one electrode which can be coupled with the electrode holding device to generate the electrostatic field, for example mechanically and/or electrically, wherein the dielectric material is, for example, arranged between the at least one electrode and the axis of symmetry or surrounds the at least one electrode asymmetrically or does not surround it or only partially surrounds it. The dielectric material can, for example, be in the form of a dielectric bulge or a dielectric projection, in particular formed as a collar-shaped projection. In this way it is possible to obtain an advantageous influence of the discharge current component of the discharge current extending in the direction of the axis of symmetry by an extension of a propagation path to the axis of symmetry along the dielectric and/or (while operating the atomizer) insulation to the rear (e.g. on the hand axis side or in the direction of the hand axis or in the direction facing away relative to the spray element). It is possible that the dielectric material, in particular the dielectric bulge or the dielectric projection, projects, for example, obliquely or curved outwards and/or to the front, and widens, for example, conically and/or is arranged coaxially to the axis of symmetry and, in particular, extends in a ring shape around the axis of symmetry. The dielectric or insulating material can be provided substantially ring-shaped with or without discontinuities. It is also possible that the at least one electrode extends into the bulge or the projection and even projects out of the bulge or the projection.

According to an exemplary illustration, the dielectric material is provided to influence or not to influence or to dampen less or not to dampen a further discharge current component which is directed in an opposite direction relative to the previously mentioned discharge current component, less than the discharge current component which is directed in the direction of or to the axis of symmetry. In this way a current discharge path is extended to the axis of symmetry, in an advantageous way, so that the electrode assembly overall can have more compact dimensions, which is advantageous for internal coating.

According to an exemplary illustration, the electrode holding device is formed, for example, in a ring shape around the axis of symmetry so that the axis of symmetry coincides with a rotary axis of the electrode holding device. The axis of symmetry can be the axis around which the electrostatic field, which can be generated by a plurality of electrodes coupled electrically and/or mechanically with the electrode holding device, arranged around the axis of symmetry, can extend out in a coronary manner, for example. The electrostatic field is particularly extendable in the direction of the axis of symmetry. For a symmetrical electrode assembly both axes of symmetry may advantageously coincide so that the dielectric material can only be formed with respect to one axis of symmetry. If the above-mentioned axes of symmetry do not coincide then the dielectric material can be provided to only take account of one of the axes of symmetry. Furthermore the dielectric material can be arranged relative to both axes of symmetry as described above.

In an assembled condition of the atomizer or for a mounted electrode assembly, the axis of symmetry may advantageously coincide with the central axis of a spray element and/or a central axis of the atomizer (e.g. central axis of an atomizer housing element or a housing element) and/or a rotary axis of the atomizer (coaxially). The above-mentioned central axes may at least flow into each other or cross over each other. In particular in an assembled condition of the atomizer or for a mounted electrode assembly an inner circumference of the electrode assembly should be adjacent to an outer circumference of a housing element of the atomizer in order to guarantee a compact atomizer construction.

The electrode assembly and/or the electrode holding device and/or the dielectric material may advantageously be fastened on the face side, in particular on a front side of the atomizer (e.g., to an atomizer housing element), such as in a ring-shaped arrangement and/or fastened by a threaded connection or by any other fastening means.

According to an exemplary illustration, the electrode assembly comprises a plurality of electrode receiving spaces and/or a plurality of electrodes which are arranged around an axis of symmetry and are coupled with the electrode holding device, in particular electrically and/or mechanically, wherein the ends of the plurality of electrodes facing away from the electrode holding device are arranged along a circular path. A ratio of a radius of the circular path to a radius of a cross-section of a spray element of the electrostatic atomizer, in particular a bell cup of a rotary atomizer, or to a radius of a cross-section of the electrode holding device, may be predetermined. For example the ratio is within a tolerance range, for example ±Π/4, equal Π. The ratio can, however, lie within a ratio range, in particular ±1% or ±2%, between 2 and 4 or between 2.5 and 3.5 or between 3 and 3.2. As an alternative, or in addition, a ratio of a product of a radius of the circular path and a distance of the circular path to a spray element of the electrostatic atomizer, for example to a bell cup or to an edge of the bell cup, to a squared diameter of this spray element, can lie within a range between 2 Π and 4 Π. Using this design rule an advantageous distance of the ends of the electrodes relative to the spray element is established.

According to an exemplary illustration, the electrode assembly comprises at least one electrode which can be coupled mechanically and/or electrically with the electrode holding device for generation of the electrostatic field. The at least one electrode may comprise an adjustable electrode length or at least a movable electrode section which can be pushed telescopically onto another electrode section or can be pushed into this one. The adjustable electrode length can be set, for example, by means of compressed air in such an advantageous way that, for example, a ring electrode array can be adapted for the external and the internal painting.

According to an exemplary illustration, the electrode assembly comprises at least one electrode which is coupled electrically and/or mechanically with the electrode holding device for generation of the electrostatic field. The at least one electrode may be encapsulated by a dielectric material, symmetrically or asymmetrically, which can, for example, be polytetrafluorethylene. In this way insulation of the electrode fingers is realized in an advantageous manner.

According to an exemplary illustration, the electrode assembly comprises a thread which may be provided coaxially to the central axis and/or the axis of symmetry.

The thread can be provided for example with an insulating medium (for example an insulating grease such as vaseline) whereby the insulation is improved, which contributes to directional reception and removal, respectively or prevention or minimization of the discharge current. The thread can furthermore be provided to detachably connect the electrode holding device with a housing of an electrostatic atomizer by means of a thread engagement. The thread can furthermore be formed from an insulating or dielectric material, whereby the insulating properties can be further improved. The thread can be conical in order to achieve self-locking. The thread may be arranged coaxially to the axis of symmetry. It is possible that the thread extends around the electrode assembly and/or the electrode holding device and/or the axis of symmetry. The thread can be provided with an insulating medium, e.g., for prevention or minimization of a discharge current or a discharge current component. The thread can furthermore be provided to achieve an advantageously enlarged discharge path and/or a labyrinth for discharge current (e.g. from a part which has a high voltage applied to it such as the tip of an electrode to one which has a lower voltage applied to it or an earthed part such as a bell cup or a drive turbine), and in particular to provide insulation to the inside and/or the rear or in order to reduce or avoid unwanted discharges.

According to an exemplary illustration, the electrode holding device comprises a first electrical connection or a connection ring for making contact with at least one electrode. The first electrical connection can furthermore be provided with a resistor or has a resistance in order to achieve adaptation of the electrical resistance of the electrode. The first electrical connection can furthermore be provided to contact a plurality of electrodes wherein one or more resistors can be provided for this purpose. The electrode assembly or the electrode holding device comprises a second electrical connection corresponding to this or a connection ring for contacting the first electrical connection, wherein the second electrical connection is led to the outside and is accessible from the outside, respectively.

The electrode assembly and/or the electrode holding device and/or the dielectric material may be substantially formed ring-shaped around the axis of symmetry or arranged coaxially to the axis of symmetry. The electrode assembly and/or the electrode holding device and/or the dielectric material and/or the below mentioned first and/or second screen can define a central opening to receive a part of the atomizer (for example of a housing element of the atomizer which, for example, houses a support unit or a drive turbine) and/or for the passage of a coating agent or other internal atomizing equipment (for example paint/air supplies, etc.).

One or more electrode receiving space(s) may be connected with one or more resistor receiving means. In a similar way one or more electrodes can be connected with one or more resistors. The resistor or resistors can be provided to be connected with a charging member provided in an atomizer housing element, e.g., a charging ring. One or more electrode receiving spaces and/or electrodes and/or resistor receiving means and/or resistors can, in particular, be spaced apart from the central axis and/or the axis of symmetry. A plurality of electrode receiving spaces and/or electrodes and/or resistor receiving means and/or resistors may be provided around the central axis and/or the axis of symmetry, and may be advantageously evenly spaced apart from each other in the circumferential direction.

The electrode assembly and/or the electrode holding device can comprise a first screen and/or a second screen. The first screen and/or the second screen can substantially be ring-shaped. The first screen and/or the second screen may be substantially arranged coaxially and/or parallel to the axis of symmetry. The first screen may have a larger diameter than the second screen. It is possible that the at least one resistor receiving means and/or the at least one resistor is arranged between the first screen and the second screen. The screen may have the thread. The thread may be arranged on the outer circumference of the first screen. The second screen may advantageously be formed stronger or thicker than the first screen. The first screen and/or the second screen may be formed from dielectric or insulating material. The first screen and/or the second screen can be provided to create a sandwich-like assembly, in particular with an atomizer housing element which is provided with at least one corresponding screen.

The electrode assembly, the electrode holding device and/or the dielectric material can comprise a substantially circular section and/or at least one (e.g., obliquely, curvilinear or in any other way pointing outwards and/or forwards, in particular substantially conically) widening and/or protruding section. The at least one widening section may be provided as the electrode holding device in which, for example, at least one electrode and/or at least one electrode receiving space is received. In one exemplary illustration, the electrode assembly can consist of the circular section and the widening section. The widening section can substantially be conical (for example with a straight formed surface line or a curved formed surface line), funnel-shaped, plate-rim shaped or in the shape of a hyperboloid of revolution (ring-shaped). In one example, just one widening section is provided which is arranged ring-shaped around the axis of symmetry and/or is located coaxially to the axis of symmetry. It is, however, also possible that the widening section has a plurality of discontinuities and thus therefore comprises a plurality of sections or consists of a plurality of sections which, for example, can also project outwards and/or to the front, be in particular evenly spaced apart from each other in the direction of the circumference, and furthermore be substantially aligned parallel or not parallel or skewed to the axis of symmetry. In particular, the widening section can extend from the substantially circular section. The widening section may (relative to the circular section and/or relative to the atomizer) project (radially) to the outside and/or (axially) to the front and/or widening. The substantially circular section may comprise the thread and/or at least one resistor and/or at least one resistor receiving space and/or the first and/or the second screen, wherein the widening section may house one or more electrodes and/or one or more electrode receiving spaces. In an assembled condition of the atomizer the widening section may project, in particular, obliquely to the front (in the direction of the spray element or to the side of the spray element) and (radially) to the outside, wherein the circular section is at least partially, and in one exemplary illustration substantially fully covered by an atomizer housing element. The widening section and/or one or more of the parts included by the circular section can be formed from dielectric or insulating material. The at least one widening section, in particular, corresponds to the electrode holding device.

According to one exemplary illustration, an atomizer housing element may be provided, in particular for holding an electrode assembly such as is, for example, described above for an electrostatic atomizer, in particular for a rotary atomizer, which comprises an atomizer housing with a housing element with a first diameter for immediate or indirect holding of a directing air ring and/or for mounting or covering of a support device for a spray element, in particular for a bell cup. The support device can, for example, comprise or be a turbine or a turbine shaft for driving the spray element. The turbine or the turbine shaft can, according to one exemplary illustration, for example, be held indirectly or directly by the housing element. According to a further exemplary illustration the housing element serves substantially to cover the turbine and/or the turbine shaft which, for example, can be held by a flange on the hand axis side. The atomizer housing element can, for example, be placed immediately upstream of the housing element and/or be connectable with the housing element. The atomizer housing element may be provided as a tube which can be formed to be straight or bent.

The housing element of the atomizer housing for the atomizer is, according to an exemplary illustration, not a feature of the atomizer housing element. According to a further exemplary illustration, the atomizer housing element can adopt the function of the housing element or create an integral or single-piece unit with this.

The atomizer housing element may comprise a second diameter which differs from the first diameter, wherein a difference in diameter between the first diameter and the second diameter establishes an electrode holding area for holding the electrode assembly. The electrode holding area can, for example, be created by a circumferential surface, the width of which is established by the difference in diameter. This surface can, for example, be arranged normal to a surface, in particular to an external surface of the atomizer housing element so that the electrode holding area is established by a direct, stepwise transition, which is determined by the difference in diameter. The electrode holding area can, however, be formed by a continuous or inclined transition which extends not normal to but rather at a flatter angle relative to the outside surface of the atomizer housing element. The electrode holding area can, furthermore, be formed by the difference in diameter at a separation boundary between the atomizer housing element and the housing element.

The atomizer housing element can comprise a first thread and/or a second thread on a first (axial) end of the atomizer housing element. Furthermore, a third thread on a second (axial) end of the atomizer housing element can be provided.

The first thread may be provided to connect the atomizer housing element with the electrode assembly, the second thread to connect the atomizer housing element with the housing element and the third thread to connect the atomizer housing element with an insulating sleeve. Furthermore, the electrode holding area can extend between a surface of the atomizer housing element and the second thread.

According to an exemplary illustration, the atomizer housing element which, for example, can be provided for insulated housing of at least one valve of an atomizer, comprises a connection area which, for example, can comprise the first and/or the second thread, to connect the atomizer housing element with the housing element and/or the electrode assembly, wherein the electrode holding area extends between a surface, in particular an outer surface, of the atomizer housing element and the connection area. The electrode holding area is therefore formed by a section of the atomizer housing element which is established by the difference in diameter and which at a connection with the housing element is not covered by this. The thread or the threads of the connection area can furthermore create a further extension of a discharge path and be provided with insulating medium (for example insulating grease, and in one exemplary illustration vaseline).

According to an exemplary illustration, the second diameter may be larger than the first diameter so that the electrode holding area or its normal, for example, points in a spraying direction. The second diameter can, however, be smaller than the first diameter which allows immediate arrangement or alignment of the electrodes to a surface of the atomizer housing.

According to an exemplary illustration, the difference in diameter establishes a surface which at least in part points in the spraying direction or a projection which at least in part points in the spraying direction, in particular circumferentially, for holding the electrode assembly.

The atomizer housing element can comprise a central axis which extends through the atomizer housing element. In an assembled condition of the atomizer, in particular in a mounted condition of the electrode assembly and the atomizer housing element, the axis of symmetry of the electrode assembly and the central axis of the atomizer housing element can coincide (coaxially). The axis of symmetry and the central axis may at least flow into each other or intersect each other.

The atomizer housing element can comprise a first screen and/or a second screen which may be provided substantially ring-shaped and particularly be arranged coaxially and/or extending parallel to the central axis. It may be advantageous for the first screen to have a larger diameter than the second screen. It is possible that at least one receiving space for a resistor receiving means and/or at least one resistor is formed between the first screen and the second screen. The second screen can be formed thicker than the first screen. The first screen and/or the second screen is particularly provided to achieve insulation and/or a labyrinth inwards or to reduce or avoid unwanted discharges. Furthermore, the screens can be provided to create a sandwich-like assembly, in particular with the electrode assembly, which is provided with at least one appropriate screen. The first screen and/or the second screen may be formed from dielectric or insulating material.

According to an exemplary illustration, the atomizer housing element is straight or can, for example, be angled in a range of angles around approximately 60°, which is advantageous for internal coating. The atomizer housing element may be angled less than about 70° or 65° and/or more than about 50° or 55°. The atomizer housing element can, furthermore, comprise at least one detachable insulating sleeve or an extension section formed in one-piece or integrally with the atomizer housing element in order to cover a receiving device (for example a bore) for a fastening means (for example a central tensioning spigot) for assembly or disassembly of an atomizer and/or a robot hand axis in an insulating manner.

According to an exemplary illustration, the electrode holding area comprises at least one electrical connection or a charging ring for electrically contacting at least one electrical connection of the electrode assembly. In this way an electrode excitation or electrode contacting is ensured over the atomizer housing element in an advantageous manner.

The first thread and/or the second thread and/or the third thread can be arranged coaxially to the central axis of the atomizer housing element, may extend around the atomizer housing element and/or its central axis and, in particular, becoming or being provided with an insulating medium, whereby prevention or minimization of a discharge current or a discharge current component can be achieved. The above-mentioned threads can be conical in order to achieve self-locking. Furthermore, the first thread, the second thread and/or the third thread can create a larger or extended discharge path and/or a labyrinth for the discharge current, in particular in order to provide insulation to the inside and/or the rear to reduce or to avoid unwanted discharges, whereby, advantageously, charging of the coating agent can be increased.

According to one exemplary illustration, an atomizer housing for an electrostatic atomizer may be provided, in particular for a rotary atomizer, with a housing element with a first diameter, wherein the housing element is suitable or provided for housing or covering a drive turbine and/or a support device for a spray element, in particular for a bell cup, and in one example the atomizer housing element for holding the electrode assembly. The atomizer housing of one exemplary illustration can consist of just the housing element while for another exemplary illustration it can further, in particular, comprise the atomizer housing element. The housing element may be provided as a tube which can, in particular, be formed straightly. It is possible that a central axis passes through the housing element or the atomizer housing.

The housing element can comprise a first thread on a first (axial) end and/or a second thread on a second (axial) end.

The first thread can be provided for connecting with the atomizer housing element, wherein the second thread can be provided for connecting with an atomizer part having a directing air ring. It is also possible that the housing element and that the atomizer part having the directing air ring are designed (integrally) as one piece or the directing air ring is formed in the housing element. The diameter of the first thread may be greater than the diameter of the second thread. In particular the first thread and/or the second thread may be arranged coaxially to the central axis of the housing element.

The first thread and/or the second thread of the housing element can extend around the housing element and/or the central axis of the housing element and may become or be provided with insulating medium. In a similar way to the threads already mentioned above, the first thread and/or the second thread of the housing element is in particular provided for prevention or minimization of a discharge current or a discharge current component, can be formed conically in order to achieve self-locking, and can be provided in order to achieve a larger discharge path and/or a labyrinth for the discharge current. Particularly, insulation during operation of the atomizer to the front and/or the inside should be achieved or unwanted discharges should be reduced or avoided, whereby, advantageously, charging of the coating agent can be increased.

According to an exemplary illustration, the electrode holding area is formed between an outer surface of the atomizer housing element and an outer surface of the housing element. Therefore the electrode holding area extends between the outer surfaces of the atomizer housing element and the housing element and is established by the difference in diameter.

According to an exemplary illustration, the atomizer housing element is detachably connected or connectable with the housing element, for example by means of a thread connection, and provided upstream the atomizer housing element with regard to an arrangement of the spray element or with regard to a spray direction.

According to an exemplary illustration, the atomizer housing and the atomizer housing element, respectively comprises an insulating cover or dielectric insulating sleeve to cover a wall on the hand axis side or to cover a (robot) hand axis, which can be earthed and/or which, for example, can house a valve arrangement or supply hoses for an atomizer. In this way a discharge current pointing to the rear and extending in the direction of the hand axis can be influenced or prevented in an advantageous manner. The dielectric sleeve consists, for example, of a dielectric material, in particular of polytetrafluorethylene, and can, for example, be connected with the atomizer housing or the atomizer housing element by means of a thread engagement or, in particular, create an (integral or) one-piece or single-part unit with the atomizer housing element and, for example, be clamped on the atomizer side by an circumferential collar.

One exemplary illustration is directed to an insulating sleeve per se. The insulating sleeve is, as mentioned above, in particular provided for insulation of installed components such as paint/air supplies or atomizer housing elements or for insulation of a wall on the hand axis side or a hand axis of the robot. The insulating sleeve can have a connection area for detachable connection with the atomizer housing element, in particular by means of a thread connection or a snap fastening. The insulating sleeve may be formed from an insulating material, in particular from polytetrafluorethylene.

The insulating sleeve can comprise a first thread on a first (axial) end and/or a second thread on a second (axial) end. The insulating sleeve may be provided as a cylinder which can, in particular, be formed straightly.

According to an exemplary illustration, the insulating sleeve may be detachably connected connection with a further insulating sleeve ("extension insulating sleeve"), in order, advantageously, to further increase the insulating effect in the direction of the hand axis or to the rear and/or to screen earthed components under the at least one insulating sleeve.

A single appropriately long insulating sleeve or the additional insulating sleeve (for example by screwing on) can in particular cover in an insulating manner a receiving means (for example a bore) for a fastening means (for example a central tensioning spigot), with which the atomizer (and in one exemplary illustration, the complete atomizer) can be disassembled in a simple manner, and/or a robot hand axis.

For example, the additional insulating sleeve can be screwed onto the second thread of the insulating sleeve (on the hand axis side). The first thread may be provided for connecting with the atomizer housing element.

The insulating sleeve is, as mentioned above, may be formed from an insulating material, in particular from polytetrafluorethylene, but can also be colored to differentiate it from other insulating components, for example by adding MoS2.

A central axis may extend through the at least one insulating sleeve. The diameter of the first thread can be substantially equal in size to the diameter of the second thread. Furthermore, the first thread and/or the second thread can be arranged coaxially to the central axis of the insulating sleeve.

It is possible that the first thread and/or the second thread extend around the insulating sleeve and/or its central axis. In a similar way to the threads already mentioned above, the first thread and/or the second thread of the insulating sleeve as well is, in particular, provided for prevention or minimization of a discharge current or a discharge current component, can be formed conically in order to achieve self-locking, and can be provided in order, for example, to achieve a larger discharge path and/or a labyrinth for the discharge current. Particularly, insulation during operation of the atomizer to the rear should be achieved or unwanted discharges should be reduced or avoided, whereby, advantageously, charging of the coating agent can be increased.

According to an exemplary illustration, the insulating sleeve has a length in a range between about 100 mm and 200 mm or about 140 mm or 160 mm. The insulating sleeve may be about 150 mm long.

According to an exemplary illustration, the surface of the insulating sleeve is, for increasing the surface, not even, but is, for example, formed wavy or structured or provided with elevations and depressions, so that the surface of the insulating sleeve can, for example, be equal to the surface of a golf ball with dimple type depressions. The surface of the atomizer housing element, the housing element or the electrode assembly can also have such a surface design in order to increase the discharge path or the leakage path, whereby a greater resistance for the current can be achieved.

The insulating sleeve can furthermore be connectable with the atomizer housing element described above, for example by means of the first thread that can be provided with an insulating medium (for example an insulating grease such as vaseline).

Another exemplary illustration is direct to an electrostatic atomizer, in particular a rotary atomizer, for example a rotary atomizer provided with an exemplary atomizer housing, an exemplary electrode assembly, and/or at least one exemplary insulating sleeve, as described above.

The atomizer is advantageously suitable for external charging for or during outside coating and for or during inside coating and/or detail coating.

The atomizer is, in particular, suitable for inside/detail coating without potential separation.

According to an exemplary illustration, the electrostatic atomizer comprises a spray element, for example a bell cup, which can be held by a support device. The support device can, for example, be a turbine or a turbine shaft which is held or covered by the housing element. The housing element can furthermore be provided for holding the directing air ring. The electrostatic atomizer furthermore comprises at least one electrode which is held by the electrode assembly. The electrostatic atomizer may in one exemplary illustration be, by means of a connection element on the hand axis side, which, for example, can be covered by an or the above-mentioned insulating sleeve, for example a flange, for example holdable on a robot arm, wherein a ratio of a distance between an electrode end of the at least one electrode, which can be coupled mechanically and/or electrically with the electrode assembly, to the spray element, in particular to an edge of the spray element, for example to a bell cup edge, to the, for example earthed, connection element on the hand axis side or to a plastic hand axis or to a housed hand axis lies within a range between 1.5 and 2 or 2 and 2.5. Furthermore a distance between an electrode end of the at least one electrode to the spray element, in particular to a spray element edge, for example a bell cup edge, can lie in a range between 80 mm and 200 mm and in one exemplary illustration be about 118 mm (greater than or approximately equal to 80 mm, 120 mm, 160 mm, 200 mm, or 240 mm and/or less than roughly 100 mm, 140 mm, 180 mm, 220 mm, or 260 mm). Furthermore a distance between the at least one electrode or its end to the first earthed hand axis element or to a connection element, for example an earthed connecting flange, of the electrostatic atomizer can lie in a range between approximately 120 mm and 625 mm or approximately be 195 mm or 240 mm (with "extension insulating sleeve"). Based on these dimensions it can be ensured that the electrostatic atomizer is particularly suitable for internal painting and has good electrical insulation properties.

For example the part of the atomizer provided with the directing air ring can partially or substantially fully screen the lateral surface of the spray element facing away from the component to be coated from a discharge current component or a discharge current, delivered by the at least one electrode, and/or screen and expose the spray element in such a way that a discharge, in particular a corona discharge, can advantageously fire on the edge of the bell cup. However, the spray element, in particular the lateral surface of the spray element facing away from the component to be coated can also substantially be arranged exposed, whereby a free air path is obtained between the at least one electrode and the spray element, in particular the lateral surface of the spray element facing away from the component to be coated. In one exemplary illustration, the spray element (for example a bell cup) does not protrude out of the atomizer part provided with the directing air ring and/or the housing element, wherein for this exemplary illustration, the front edge of the atomizer part provided with the directing air ring defines the front end of the atomizer. The spray element may in one exemplary illustration be partially or fully housed in the atomizer part provided with the directing air ring and/or the housing element, for example in that the outer circumference of the spray element is partially or fully enclosed by the atomizer part provided with the directing air ring and/or the housing element.

According to an exemplary illustration, the electrostatic atomizer comprises the insulating sleeve(s) described above covering a wall of the electrostatic atomizer or its housing.

According to an exemplary illustration, the electrostatic atomizer comprises the at least one insulating sleeve mentioned above wherein the electrostatic atomizer can also be provided with a directing air ring, wherein the electrode assembly has at least one electrode, and wherein the electrode assembly and/or the housing element is formed from dielectric material for influencing a current component, extending in the direction of the axis of symmetry and/or in the direction of the spray element, for charging an atomizable paint or an atomized paint and/or formed for influencing the discharge current component.

According to an exemplary illustration, the electrode assembly and/or the housing element and/or the insulating sleeve and/or the directing air ring (or the atomizer part provided with the directing air ring) can respectively be held by a thread, in particular coated with or surrounded by an insulating medium or insulating fluid (for example an insulating grease such as vaseline), and/or wherein the thread (on the electrode assembly) includes at least one screen, in particular coated with an insulating medium, wherein the thread and/or the at least one screen are provided to achieve an extension, in particular through a labyrinth, of a discharge current path.

According to an exemplary illustration, the at least one insulating sleeve and/or the directing air ring (or the atomizer part provided with the directing air ring) and/or the electrode assembly and/or the housing element and/or the atomizer housing element and/or a spray element, in particular a bell cup, are modularly exchangeable and may be adaptable or adapted to a respective application scenario which comprises an inside coating and an outside coating. In one exemplary illustration, the directing air ring (or the atomizer part provided with the directing air ring), the electrode holder (or the electrode assembly) and the spray element, in particular a bell cup, may be exchanged modularly.

One exemplary illustration is directed to a method of operation, such as an electrostatically supported atomizing method, for example with external charging of the coating agent and, in particular, for external charging of the coating material for the internal/detail coating, at which a spray jet is atomized by means of electrostatic atomization, in particular rotary atomization, with the steps of generation of an electrostatic field for electrostatic charging of the spray jet around an axis of symmetry, such as around one of the above-mentioned axes of symmetry, and, for example, electrical influencing of a discharge current component of the discharge current, which can advantageously extend in the direction of the axis of symmetry, using a dielectric material.

As an alternative, or in addition to this, the method of operation can comprise performing external charging of a coating agent during the internal/detail coating and, in one exemplary illustration, the external coating.

Advantageously an internal/detail coating can be performed without potential separation.

For the method of operation it is possible, with the same atomizer and/or the same external charging system, advantageously, to perform internal/detail coating and an external coating with low-resistance paints (for example solvent-based paints) and/or water-based paints. Furthermore, it is possible with the same atomizer and/or the same external charging system, advantageously, to perform external charging of the coating agent during internal/detail coating and external coating. Initially, an internal coating can be performed, for example, and subsequently an external coating (or vice versa).

The method of operation may also comprises external charging of a water-based paint or a solvent-based paint during internal painting and/or detail painting.

According to an exemplary illustration, the discharge current component opposing the discharge current component of the discharge current is less influenced or not influenced, in particular less or not dampened.

According to an exemplary illustration, the electrostatic field is generated by one or more electrodes arranged around the axis of symmetry.

The method of operation can be performed using a painting distance between the front edge of the atomizer (for example the front edge of the spray element or the front edge of the atomizer part provided with the directing air ring) and the component to be painted, the painting distance being greater than or equal to approximately 5 mm, 10 mm, 50 mm, 100 mm, 150 mm, or 200 mm; and/or is less than approximately 7.5 mm, 25 mm, 75 mm, 125 mm, 175 mm, or 225 mm.

Further method steps arise directly from the functionality of an exemplary electrostatic atomizer.

One exemplary illustration is directed to a method for manufacturing the electrode assembly described above with the steps of forming an electrode holding device for holding the electrodes around an axis of symmetry and forming a dielectric material for influencing a discharge current component of a discharge current extending in the direction of the axis of symmetry.

Further manufacturing steps arise directly from the structure of the electrode assembly described above.

One exemplary illustration relates to a method for manufacturing an atomizer housing as described above for holding an electrode holder as described above for an electrostatic atomizer, in particular for a rotary atomizer, with the step of forming the atomizer housing element with the second diameter, in order to establish an electrode holding area for holding the electrode assembly by means of a difference in diameter between the first diameter and the second diameter.

Further manufacturing steps arise directly from the structure of the atomizer housing element described above.

One exemplary illustration relates to a method for manufacturing an atomizer housing as described above with the steps of forming the housing element which is suitable or provided for receiving or covering a support device, for example a turbine and/or a turbine shaft, for a spray element, particularly for a bell cup, and/or for holding a directing air ring, with the first diameter, and forming of the atomizer housing element.

Further manufacturing steps arise directly from the structure of the atomizer housing mentioned above.

Another exemplary illustration relates to a method for manufacturing an electrostatic atomizer as described above with the steps of forming the atomizer housing, forming the electrode assembly and bringing together the atomizer housing and the electrode assembly to obtain the electrostatic atomizer. The bringing together step can, for example, comprise the step of connecting, for example by means of a thread engagement.

According to an exemplary illustration, the method comprises the step of forming the insulating sleeve, in particular for insulation on the hand axis side or influencing a discharge current component on the hand axis side.

Further manufacturing steps arise directly from the structure of the electrostatic atomizer described above.

Another exemplary illustration relates to a method for manufacturing an insulating sleeve as described above, wherein the connection area is formed with a thread to create a discharge path.

Further manufacturing steps arise directly from the structure of the insulating sleeve described above.

One exemplary illustration relates to use of the electrostatic atomizer described above for internal/detail coating, in particular internal/detail painting, of vehicle bodies (for example door entrances, windows, etc.) or of small parts such as those made from plastic or attachment parts or bumpers or fenders, in particular bumper bar elements or bumper bars or bumper strips. As an alternative, or in addition to this, one exemplary illustration relates to use of an electrostatic rotary atomizer (for example, as described above) and/or an electrode assembly (for example, as described above) for external charging of a coating agent in internal/detail coating and, for example, also in external coating.

The parts according to the exemplary illustrations (for example the electrode assembly, the atomizer, the method of operation, etc.) are provided for external charging of coating agent (in the internal/detail coating and/or the external coating). The exemplary parts (for example the electrode assembly, the atomizer, the method of operation, etc.) may be particularly suitable for external coating of, for example, motor vehicle bodies, attachment parts, etc., also for internal/detail coating of, for example, motor vehicle bodies (for example door entrances), attachment parts, small parts, bumpers or fenders, bumper bar elements, bumper bars, bumper strips, etc.

In one exemplary illustration, positioning monitoring of an object to be coated can be achieved by evaluation of current (I) and voltage (U). The positioning monitoring comprises, for example, the position and/or alignment or state of an object to be coated.

In an assembled condition, or during operation of the atomizer, the symmetry or central axis of the electrode assembly, the central axis of the atomizer housing element, the central axis of the housing element, the central axis of the atomizer housing and/or the central axis of the insulating sleeve(s), coincide (coaxially) or at least flow into each other or intersect each other.

The electrode assembly, the electrode holding device, the atomizer housing element, the housing element, the insulating sleeve and/or the atomizer part provided with the directing air ring can be partially provided with dielectric or insulating material or be coated or encompassed by dielectric or insulating material.

The electrode assembly, the electrode holding device, the atomizer housing element, the housing element, the insulating sleeve and/or the atomizer part may be provided with the directing air ring can be made from dielectric or insulating material, may be formed as one piece, and/or substantially consist of dielectric or insulating material.

Also individual groups of components (for example the electrode assembly, the at least one insulating sleeve, the atomizer housing element, the atomizer housing, the housing element and/or the directing air ring (or the atomizer part provided with the directing air ring) can be formed as one-piece (integrally) or in one part. Thus, for example, the atomizer housing element and the at least one insulating sleeve can be formed as one-piece or in one part. Furthermore, for example, the atomizer housing element and the at least one insulating sleeve and the electrode assembly can be formed as one piece or in one part. In a similar way the electrode assembly can also be formed as one piece or in one part with the housing element and/or the atomizer housing element. It is also possible to form the housing element and the directing air ring (or the atomizer part provided with the directing air ring) as one piece or in one part so that the directing air ring can be integrated into the housing element.

The dielectric or insulating material may be a high voltage resistant material, in particular made from a fluoroplastic or fluoroplastic compounds such as polytetrafluorethylene. In this way it is possible to achieve minimization or avoidance of unwanted discharges, whereby, advantageously, charging of the coating agent can be increased.

Furthermore, also the spray element (for example a bell cup) can at least partially be made from a dielectric or insulating material or consists of it, in particular when another counter-electrode/ignition electrode is provided for ignition of the necessary (corona) discharge.

The threads described above are merely exemplary illustrations for detachable connections or connection mechanisms. It is also possible to provide other detachable connections (for example snap-fit connections, latching connections, clamp connections, Velcro fasteners, screw connections, etc.) in order to rapidly, and without great effort, assemble, disassemble or replace the electrode assembly, the housing element, the atomizer part provided with the directing air ring, the atomizer housing element and/or the at least one insulating sleeve in an advantageous way. The electrode assembly, the housing element, the atomizer part provided with the directing air ring, the atomizer housing element and/or the at least one insulating sleeve may be provided detachably or removably or replaceably.

The threads described above are, however, advantageous, since they extend discharge paths or "creepage distances" (from a high electrical potential to a low or earth potential). In this way the threads or the discharge paths represent a labyrinth for the discharge current. Furthermore, the threads advantageously provide a detachable connection.

All or some of the parts formed from insulating or dielectric material can have rounded edges.

The connecting mechanisms of the respective components, for example some or all of the threads described above and below, may be lubricated or provided with an insulating medium (for example insulating grease, such as vaseline).

In an assembled condition or during operation of the atomizer a distance (d1) between an electrode end of the at least one electrode to the spray element, in particular to a spray element edge, or generally to the front-most part of the atomizer, can lie in a range between more than 75 mm, 125 mm, 175 mm, 225 mm or 275 mm, and/or less than 100 mm, 150 mm, 200 mm, 250 mm or 300 mm, and in one exemplary illustration in the range between 80 mm and 250 mm. An axial distance (d3) between an electrode end of the at least one electrode to the spray element, in particular to a spray element edge, or generally to the front-most part of the atomizer can lie, in one exemplary illustration, in a range between more than 60 mm, 100 mm, 140 mm, 180 mm or 220 mm, and/or less than 80 mm, 120 mm, 160 mm, 200 mm or 240 mm, and in one exemplary illustration, in the range between about 105 mm+/−25 mm. In this way an extremely compact and flexible atomizer can be achieved which, for example compared to conventional atomizers with long electrode fingers, can be operated closer to or around the component to be coated.

FIG. 1 shows a rotary atomizer with an electrode assembly which comprises an electrode holding device 101 for holding at least one electrode or a plurality of electrodes. Furthermore, there is dielectric material 103 provided in order to influence at least one component of a discharge current which extends in the direction of an axis of symmetry 105. The dielectric material is, for example, bulged towards the axis of symmetry 105 and, for example, consists of polytetrafluorethylene. There are a plurality of recesses (electrode receiving spaces) 107 formed in the electrode holding device 101 which is provided to receive electrodes 108. The electrodes 108 can respectively be contacted over resistors 109 in order to achieve a flashover-free excitation of the electrodes regulatable by the high voltage control unit for generating an electrostatic field.

The electrodes 108 may have a length which can correspond to the length of the recess 107 so that the electrodes 108 are embedded in the electrode holding device 101 fully or except for their tips pointing to the outside, whose free length can be 1 mm to 5 mm.

The electrode assembly comprises a connection area 111 which, for example, can be formed by a thread and be provided for holding the electrode assembly on an atomizer housing element 113 that can house a valve 114.

The atomizer housing element 113 furthermore comprises an electrode holding area 115 at which the electrode assembly can be held. The electrode holding area 115 is established by a difference in diameter between a first diameter of a housing element 117 of the rotary atomizer and a second diameter of the atomizer housing element 113. Therefore the difference in diameter establishes a circumferential surface whose normal extends parallel to the axis of symmetry 105. The electrode holding area 115 comprises, for example, a thread 116 into which the thread of the connection area 111 engages.

The housing element 117 is, for example, provided to receive a support device for a spray element (119), in particular for a bell cup, or to cover it in an insulated manner. The support device can, for example, be or comprise a turbine not shown in FIG. 1 or a turbine shaft 120. There is, for example, a directing air ring 121 or an atomizer part provided with a directing air ring arranged between the housing element 117 and the spray element 119 which can be held by the housing element 117. The housing element 117 and the directing air ring 121 can also be formed as one piece or as one part.

The atomizer housing element 113 is arranged upstream of the housing element 117 and is connected to this, for example, by means of a threaded connection 123 or a clamp connection or a latching connection or a glued connection.

Furthermore, there can be screens 125 provided of the same thickness or different thicknesses in the connection area 111 which can be concentric or which can form a labyrinth to achieve discharge paths as large as possible, so-called creepage distances.

Figure 2:
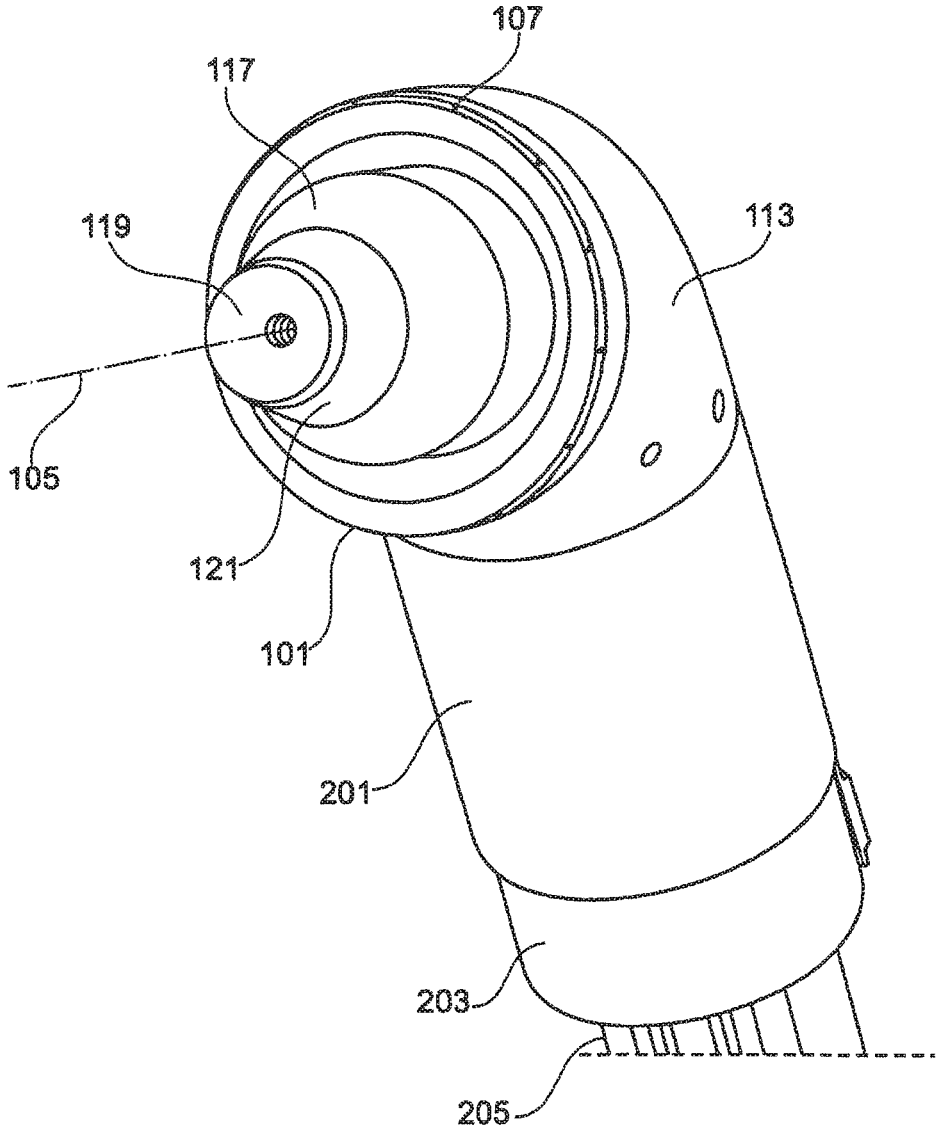
FIG. 2 the exemplary electrostatic rotary atomizer from FIG. 1.

FIG. 2 shows the electrostatic rotary atomizer from FIG. 1 with the electrode assembly comprising the electrode holding device 101, in which the recesses 107 are formed. The electrode assembly is held on the atomizer housing element 113 which can, for example, be angled at 60° or be straight. A dielectric sleeve 201 which covers a hand (wrist) axis 203 is arranged upstream of the atomizer housing element 113. A valve arrangement can be provided which can be supplied, for example, with coating agent by means of the feed lines 205. The insulating sleeve 201 is connected to the atomizer housing element 113, for example by means of a threaded connection. The insulating sleeve 201 can furthermore be glued to the wall 203.

A basic paint, i.e. a primer, a basic layer BC 1 (BC: Base Coat), an effect layer BC 2 and a clear coat layer CC (CC: Clear Coat) can be provided as a coating agent. It is also possible to have further coats such as a multi-layered clear coat in order to obtain a particularly advantageous coating quality of an object to be painted.

The atomizer shown in FIGS. 1 and 2 comprises an atomizer housing which is particularly suited for internal painting due to its, for example, 60° angled atomizer housing element 113. The atomizer housing element 113 can, for example, have an integral charging ring which is provided for electrode contacting or electrode loading. The electrodes can be placed on or screwed on together with the electrode assembly in the form of an electrode ring. According to an exemplary illustration, the charging ring can, however, also be formed by the electrode assembly.

The atomizer housing element 113 with the charging ring can be formed from an insulating and high voltage resistant material, for example from polytetrafluorethylene (PTFE), since the PTFE or other fluoroplastics offer sufficient insulating properties for internal or external skin painting or painting of attachment parts to obtain good coating results.

Figure 3A:
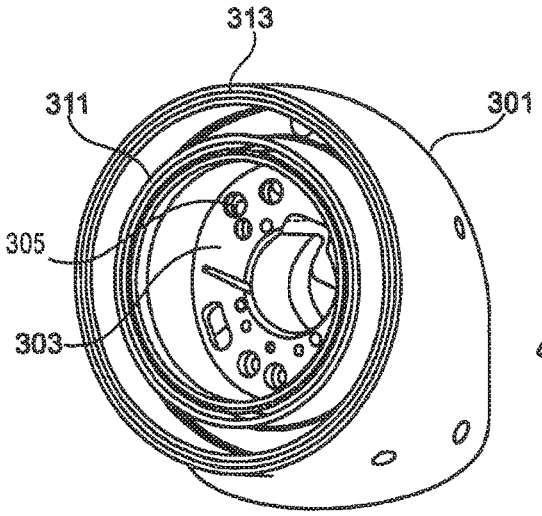
FIGS. 3*a*-3*c* views of an exemplary atomizer housing element angled at about 60°.
Figure 3B:
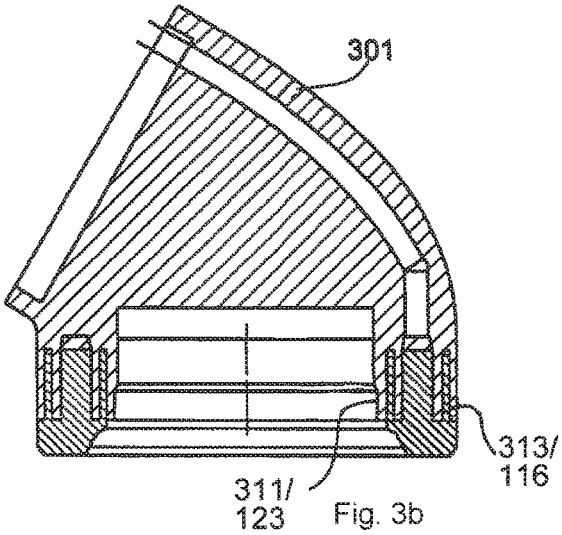
Figure 3C:
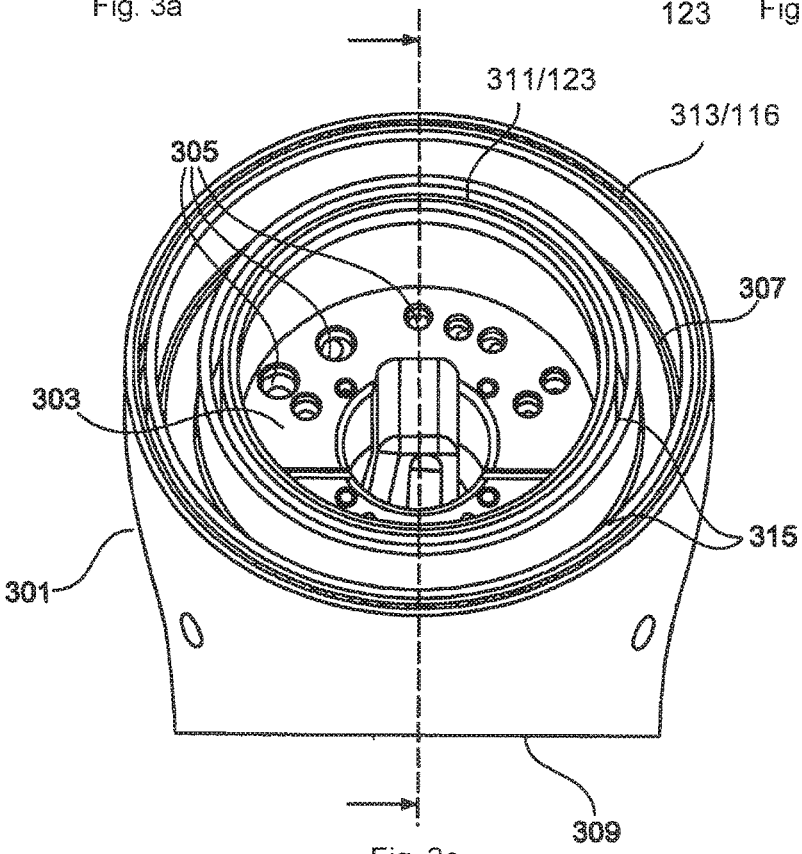

In FIGS. 3*a*-3*c* there are views shown of an atomizer housing element 301 which is angled for example at 60°. The atomizer element 301 comprises, for example, an element 303 with channels 305 for supplying supply lines of a paint supply valve block to the atomizer. Furthermore, a conductive distributor ring is guided in a charging ring 307 which may be formed from metal or a conductive PTFE or from another conductive fluoroplastic. A high voltage cable can, for example, be led to the charging ring 307 in order to achieve adequate electrode contacting with a high voltage generator. Both low resistance high voltage cables (standard) as well as high voltage cables with a high impedance at high frequencies can be used. The distributor ring 307 can, for example, be inserted or sintered into the atomizer housing section 301.

Guiding through the atomizer housing element 301 takes place, for example, unevenly, wherein the necessary feedthroughs for the fiber optic cables or for the high voltage cables can, for example, be made concealed in the PTFE by means of a sintering process. A generative manufacturing process can be used, for example, instead of a sintering process for manufacturing the 60° atomizer housing element 301.

The atomizer housing element 301 can, for example, be formed by an insulating sleeve which can also be angled at 60° or can take another form and can consist of PTFE or of other fluoroplastics or fluoroplastic compounds in order to obtain a high voltage screening effect. As an alternative ceramic materials and/or other plastics, for example a vaseline filling or a transformer oil filling, can be used. Furthermore, an insulating sleeve can be joined or screwed, for example, on the hand axis side to the atomizer housing element 301 or represent an integral part of or a single unit with the atomizer housing element. The atomizer housing element 301 can, for example, have a hand axis side thread 309 for this purpose which is intended for connection with the insulating sleeve. The insulating sleeve can, furthermore, one-sided or two-sided be put over or welded over the inner components of the atomizer. Furthermore, the atomizer housing element 301 can have a straight form or be angled at 90°.

The atomizer housing element 301 can have a thread 311 on the atomizer side which is provided to connect with a housing element of the atomizer, for example with the housing element 117 shown in FIG. 1. In contrast to the thread 309, which, for example, can be a M125×2 thread with a thread length of 12 mm, the thread 311 can be a M110×2 thread with a thread length of at least 9 mm, and in one exemplary illustration 20 mm. Furthermore, there is a further thread 313 provided with a larger diameter in order to hold an electrode assembly as shown, for example, in FIG. 1 and which can be formed in the shape of an electrode ring. The further thread 313 can, for example, be a M165×2 thread with a thread length of 12 mm.

The threads 309, 311, or 313 can, for example, be conical and designed to be self-locking, in order to achieve largest possible discharge paths, so-called creepage/leakage distances, for example, from a higher electrical potential to an earth potential. In this configuration these discharge paths or creepage distances represent a labyrinth for the discharge current so that an insulation directed inwards can be achieved in an advantageous manner. In addition, screens 315 can be provided for this purpose which achieve a further extension of the discharge path. The screens 315 can have different thicknesses or strengths; in one exemplary illustration the screens pointing inwards are thicker than those pointing outwards in order to achieve adequate insulation inwards.

Instead of leading a high voltage cable from a generator through the 60° housing 301 to the distributor ring 307, a generator or a plurality of generators can also be immediately integrated in the atomizer housing element 301 and, for example, supply all or individually grouped electrodes or electrode tips with a high voltage for generating an electrostatic field. The high voltage cable can also be directly firmly integrated into the atomizer housing element 301 and embedded in, for example, an insulating medium, for example vaseline, cast and connected outside in the area of a robot arm or in a connecting flange area of the atomizer with a high voltage supply cable which is connected with a high voltage generator, for example plugged in or screwed on over a coupling element. Furthermore, the high voltage cable can also be installed on the opposite side in the atomizer housing element 301 and an appropriate channel or channels slidable into each other, made from an insulating material, for example PTFE, for guiding and fixing the high voltage cable can be provided.

Figure 4A:
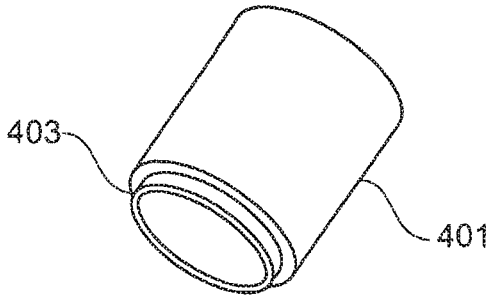
FIGS. 4*a*-4*b* views of an insulating sleeve, according to one exemplary illustration.
Figure 4B:
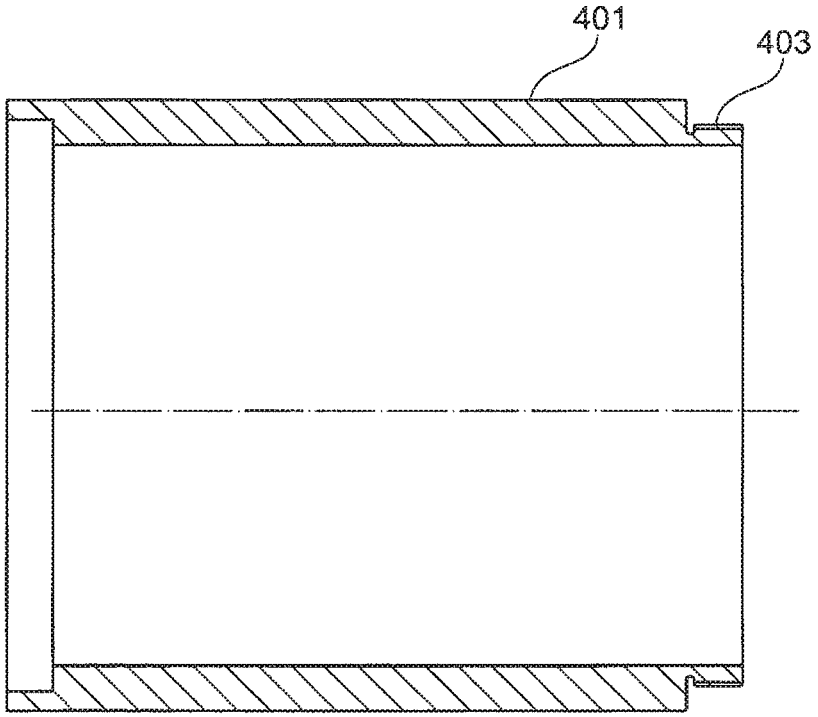

FIGS. 4*a*-4*b* show views of an insulation sleeve 401 for insulation on the hand axis side of an electrostatic atomizer. The insulation sleeve 401 may be cylindrical in shape, e.g., due to insulation against discharges which lead from the tips of the electrodes to the earthed hand axis of a/the robot and, for example, consists of PTFE. The insulation sleeve 401 can, for example, be screwed by means of a thread 403 onto the, for example, atomizer housing element 301 shown in FIGS. 3*a*-3*c*. Furthermore, there can be a plurality of cylindrical sleeves provided. In order to reduce weight it is possible to use foam materials for example, instead of PTFE materials with a grid-type crosslinking or multi-ply layers can be used, wherein the insulation may be achieved as in the case of PTFE. For example the insulation sleeve 401 has a thickness in the range of 15+/−10 mm and a length of, for example, 150 mm. The insulation sleeve may produce an insulation which is a prerequisite for obtaining greater charging of the spray jet and may advantageously allow no or weak parasitic discharges, for example, to the hand axis.

An insulation path of at least 150 mm, which, for example, represents the length of the insulation sleeve, can also be created in that the earthed hand axis of the rotary atomizer takes on insulating properties. In this case either the whole hand axis of the rotary atomizer or a part of its surface can consist of an insulating material, for example PTFE. In this way, as a further advantage, the length of the atomizer will be reduced with the same length of insulation path so that, for example, longer insulation paths of up to 150 to 500 mm can be realized for longer atomizers. The TCP (TCP: Tool Center Point) could therefore also move nearer to the hand axis whereby the atomizer becomes smaller. Also one or more further cylindrical insulation sleeves can be screwed onto the existing insulation sleeve or attached in another way to extend the insulation path, in that partial areas of the earthed hand axis are covered ("extension insulating sleeve").

The thread 403 is, for example, a M125×2 thread with a thread length of 12 mm. The thread 403 may be greased with an insulating medium, for example insulating grease, in particular vaseline, in order to effectively avoid unwanted creepage distances for possible discharge currents in combination with the thread 403, which represents an insulation labyrinth. The insulation sleeve 401 can have a surface which can be both smooth but also wavy in order to obtain further creepage distances as are usual for standard insulators in high voltage engineering. The larger the surface of the insulation sleeve 401 the greater will be the creepage distances for a discharge current from electrode tips with a high voltage applied to them to the earthed hand axis, that is to the rear. By increasing the surface of the insulation sleeve it is possible to reduce an unwanted discharge current since a greater resistance for the current is realized by the longer creepage distances.

Furthermore, insulation of all earthed parts can be undertaken by surface coating with a plastic which is either conductive or not conductive, using an insulating plastic. When surface coating it may be advantageous to ensure that there are no or only few conductive particles on the surface in order to avoid reduction of the insulating effect. Use of antistatic agents for a homogeneous, flat electrical behavior is also possible here. A further possibility to bring the charged spray jet or paint mist in an exemplary manner to the body to be coated or the workpiece or object to be coated is to bring the insulating parts of the atomizer partially or completely through use of, for example, conductive or partially conductive materials to the same negative potential corresponding to the high voltage supply or the electrode potential. However, the whole insulation may be achieved using PTFE.

Figure 5B:
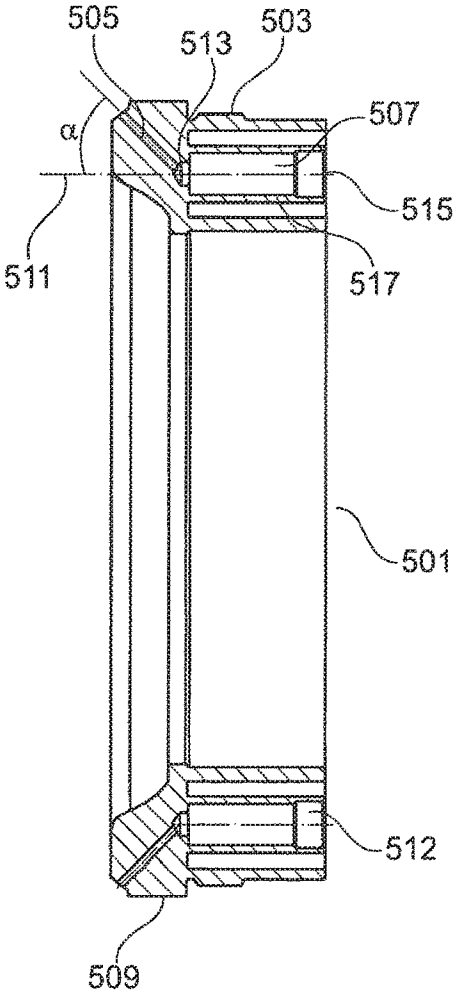
FIGS. 5*a*-5*b* views of an electrode assembly, according to one exemplary illustration.
Figure 5A:
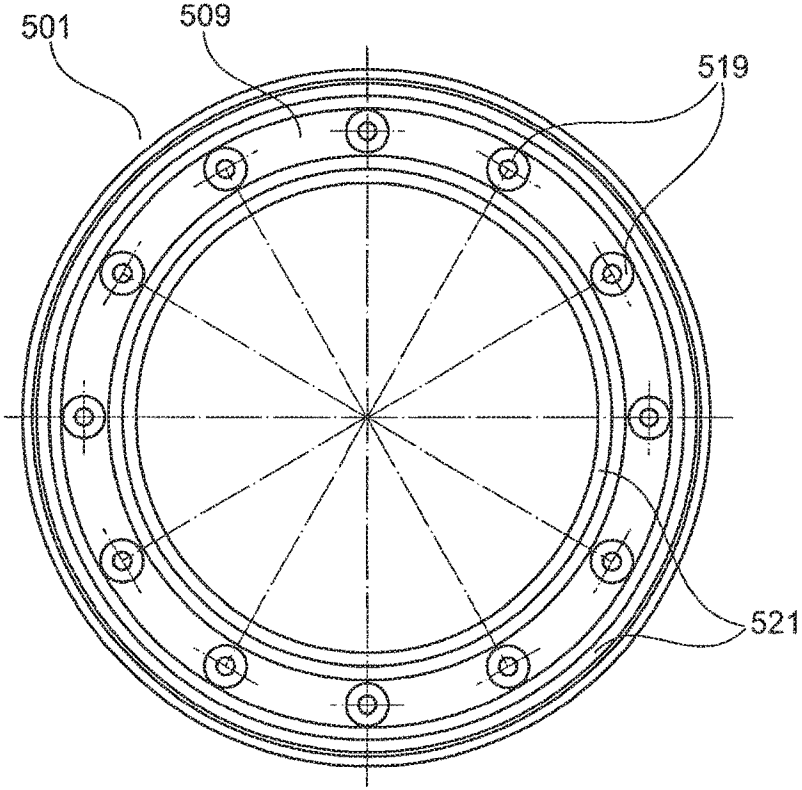

FIGS. 5*a*-5*b* show various views of an electrode assembly with an electrode holding device 501 which can correspond to the electrode holding device 101 shown in FIG. 1, which is formed in the shape of a ring or electrode ring with a diameter of 65 to 300 mm and which can be connected by means of a thread 503 with an atomizer housing element, as is shown, for example, in FIG. 1.

The electrode assembly comprises, for example, a plurality of electrodes 505, for example 3 to 60 electrodes with electrode tips, whose diameter is 1.5±1.2 mm and which can be formed, for example, out of stainless steel or other metals or conductive, carbon-based materials such as layers of diamonds or carbon nanostructures or their compounds, which have a high field emission. The electrode tips 505 with the respective resistor 507 are, for example, inserted or insertable at the same distance in an electrode holding device 509 which can be formed from a dielectric material, wherein the overall diameter of the electrode ring may be about 220 mm.

The electrode tips of the electrodes 505 can, for example, be arranged at an angle α between 0° and 180° with reference to an axial colour pipe direction 511. The electrodes can, however, have an angle of 25° to 90° in a tangential direction. In one exemplary illustration, it may be advantageous, however, to have axial angles of 55° and tangential angles of 90°.

The electrodes 505 can, for example, be embedded in the electrode holding device 509, which can correspond to the electrode holding device 501 or the electrode holding device shown in FIG. 1, except for the electrode tips which are free standing and can be 1 mm to 5 mm. The electrodes 505 can, however, be recessed or housed in the electrode holding device 509 or covered by an insulating plastic part.

The ends of the electrodes 505 may be arranged in such a way that, for example, they each abut against the resistors 507 in a charging ring which, for example, are provided with a pressure point 513. In this way, for example, each tip of the respective electrode 505 touches a resistor 507, wherein it is conceivable that two or more electrode tips touch a resistor 507 in order to realize an effective corona charging of the paint at low voltages. In this connection, for example, a maximum number of 12 electrodes or electrode tips can be provided per resistor which allows a maximum in total of 720 electrode tips.

The resistors 507 can, for example, have resistance values R of 30 to 400 MΩ wherein it may be advantageous to use resistance values of 100 MΩ with 5% tolerance. The constructional size of the resistors is (L×D) 30 to 100 mm×6 to 12 mm, for example 30 to 60 mm×8 mm. Also a series connection made out of two or more resistors is conceivable.

The opposite side of the respective resistor 507 can also be provided with a pressure point 515 which can operate together with the already described, conductive, and in one exemplary illustration metallic high voltage distribution ring.

Since relatively high voltages can drop on the resistors 507 which can result in a spark discharge or a sparkover through air along a resistor surface it may be advantageous to ensure that a space 517 is filled by an insulating medium and a dielectric strength in this closed off area of at least 1.3 kV/mm is guaranteed permanently. For this purpose, the resistors 507 can be embedded in a cylindrical resistor receiver 519 in an insulating medium, for example an insulating grease, such as vaseline, and closed off by a plastic cap 512. An insulating casting compound or a solid or liquid adhesive can also be used as an insulating material or a direct embedding of the resistor 507 in PTFE can also be possible.

Instead of a resistor 507 a resistor element can also be realized using partially conductive plastic or a semi-conductor, which permanently delivers the same resistance value as a commercially available thick-film resistor 507.

Figure 6A:
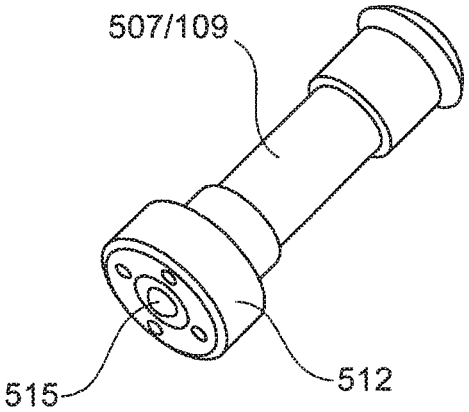
FIGS. 6*a*-6*c* views of a resistor, according to one exemplary illustration.
Figure 6B:
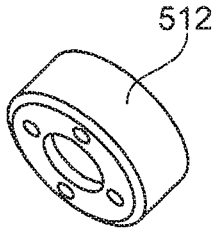
Figure 6C:
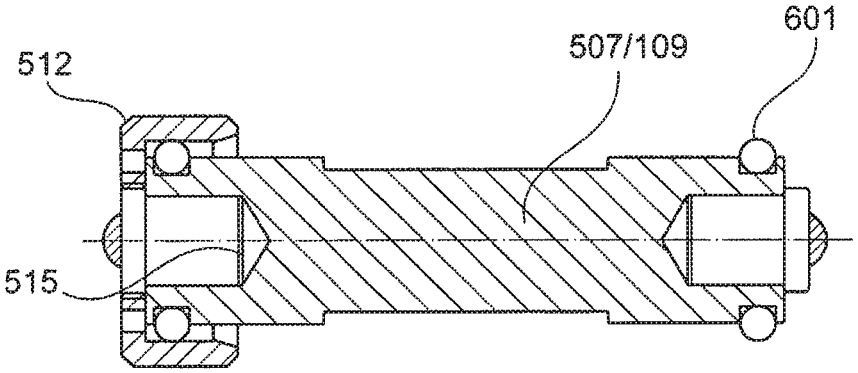

FIGS. 6*a*-6*c* show various views of a resistor 507 with the sealing cap 512, wherein a sealing ring 601 can be provided. To prevent flowing out of liquid insulating medium (e.g. insulating grease), a further sealing ring can be provided on the opposite side of the resistor, for example integrated in the insulating cap 512.

In order to process the insulating medium, for example insulating grease, for example vaseline, it can be heated above 100° C. and liquefied. The insulating grease is slowly and evenly be introduced into the space 517 with the resistor 507 in place using a dosage tip. In this connection it may be advantageous just to use one sealing ring 601. The insulating medium is present in a solid form or a liquid form dependent on the ambient temperature. In exceptional situations or fault situations which can lead to warming of the resistor 507 the insulating medium becomes liquid and thus possesses a self-healing effect in that it distributes itself ideally. Escape of the insulating medium can be prevented by the insulation cap 512.

The electrode holding device 509 can be screwed by a thread, greased with an insulating medium, for example vaseline, onto the atomizer housing element 113 as shown, for example, in FIG. 1. The thread can, for example, be an M165×2 thread with a thread length of 12 mm. Furthermore, one or more screens 521 can be provided as a further labyrinth according to the thickness of the electrode holding device 501, that is the electrode holding ring, in order to provide for an adequate insulation inwards.

Figure 7:
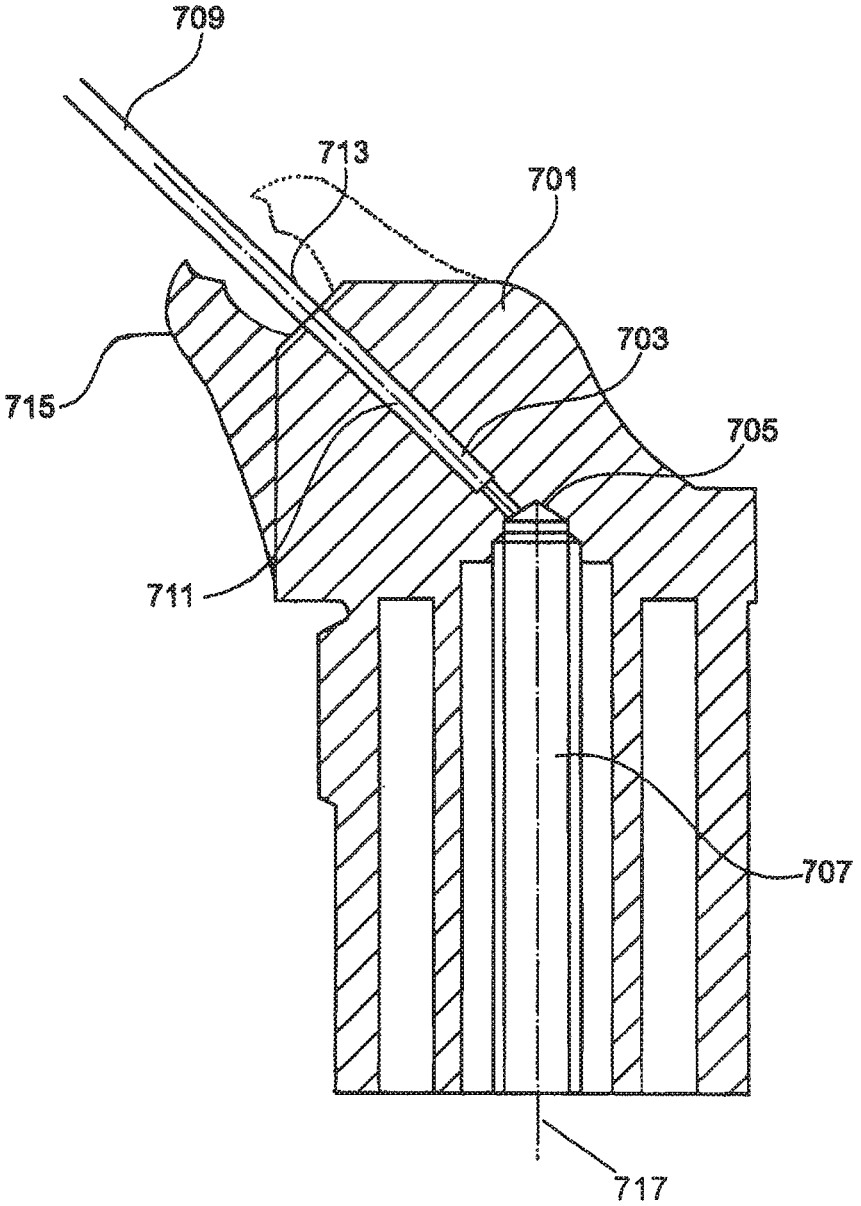
FIG. 7 an electrode assembly, according to one exemplary illustration.

FIG. 7 shows an electrode assembly with an electrode holding device 701 which can correspond to the electrode holding devices 509 or 501 or 101, in which an electrode 703 is arranged. The electrode 703 makes contact with a resistor 707 by means of a pressure point 705.

The electrode 703 can be formed in different ways. According to an exemplary illustration 709 the electrode can have a free standing end with a length of 1 mm to 5 mm wherein the electrode nevertheless is, for the most part, embedded in the dielectric material of the electrode holding device 701. According to an exemplary illustration 711 the electrode is recessed or housed and may be totally surrounded by the dielectric material of the electrode holding device 701. According to a further exemplary illustration 713 the electrode can be covered by a dielectric material 715 which forms an insulating plastic part. The dielectric material 715 can, for example, be in the form of a projection or a bulge (for example pointing to the front and/or pointing to the outside) and be provided in order to influence a discharge current component which extends in the direction of the axis of symmetry 717 or to the rear (for example hand axis side or in the direction of the hand axis or in the direction facing away relative to a spray element), for example to dampen it. Furthermore individual features of the above mentioned and/or below mentioned exemplary illustrations can be combined together in order to obtain further exemplary illustrations. It is also possible to provide the dielectric material 715 such that a discharge current component is influenced, in particular dampened, towards the rear and/or towards the outside and/or towards the front and/or towards the inside. For this purpose the dielectric material can also be provided as for example indicated by the dashed lines in FIG. 7.

Figure 8:
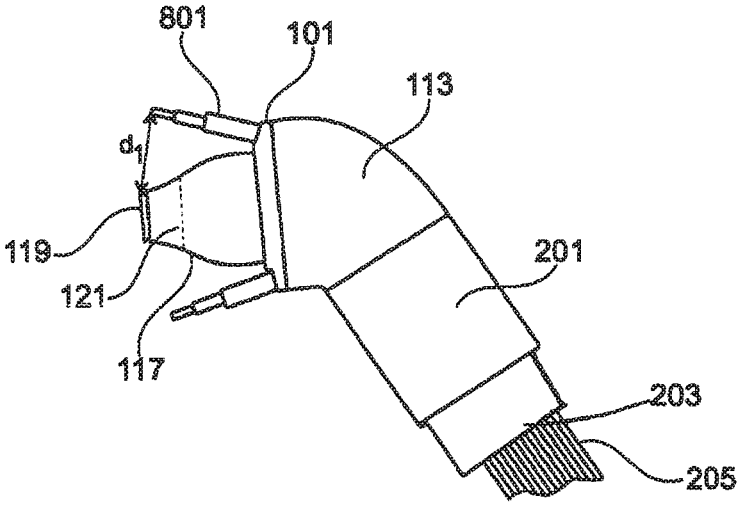
FIG. 8 a rotary atomizer according to a further exemplary illustration.

FIG. 8 shows a rotary atomizer with the elements of the atomizer from FIGS. 1 and 2, which for example is provided with telescopic electrodes 801. For painting the outer skin the electrodes 801 can be provided as screw-on electrode fingers consisting of an electrode tip with one or more resistors. Furthermore cylindrical insulating plastic sleeves can be provided in various lengths.

In order to obtain a flexible and length adjustable electrode 801 its electrode finger can respectively consist of differently sized elements which, for example, are held together by springs. These elements can each be pushed apart using compressed air in order to obtain different electrode lengths. To do this it is also possible to use other processes which, for example, use a cable or a liquid in a cylinder which, for example, is filled with detergent, or a solvent or a transformer oil. In this connection the distance d1 shown in FIG. 8 between an electrode end and the spray element 119 or its edge is d1=80-250 mm, and in one exemplary illustration 140 mm. For outer skin painting the electrode fingers can move out and for internal/detail painting they can be correspondingly moved in.

Figure 9A:
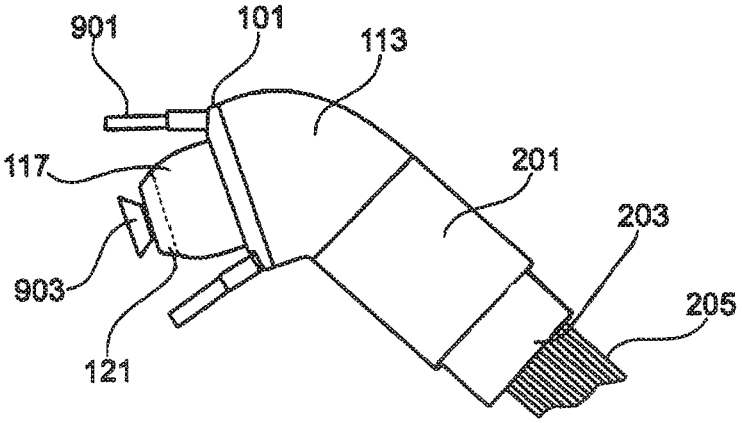
FIG. 9*a* a rotary atomizer according to a further example.

Furthermore, various electrode assemblies can be provided with electrode fingers which are differently long and not length adjustable in order, for example, to be in a position to select the most suitable electrode length for the respective application, for example modularly. As shown in FIG. 9*a*, for example, electrode fingers 901 in various lengths which are not length adjustable can be provided wherein by replacing the electrode assembly or the electrode ring and the bell cup or the directing air ring system all possible external charging applications are possible, in particular painting at discharge rates of more than 1000 ml/min using appropriate application systems. The electrode fingers 901 can also differ from each other in their lengths so that asymmetrical distances are possible, which are selected in such a way, dependent on the painting direction or the air flow direction, that an even, adapted spray pattern is obtained. Furthermore, a spray element 903, for example a bell cup, can be used free standing. Furthermore, a combination of the example illustrations shown in FIGS. 8 and 9*a*, 9*b* is possible so that, amongst other things, an option is made available to adapt an electrode length and thus also the electrical field immediately in one process and to react to any changes in the cabin conditions or a painting direction.

Figure 9B:
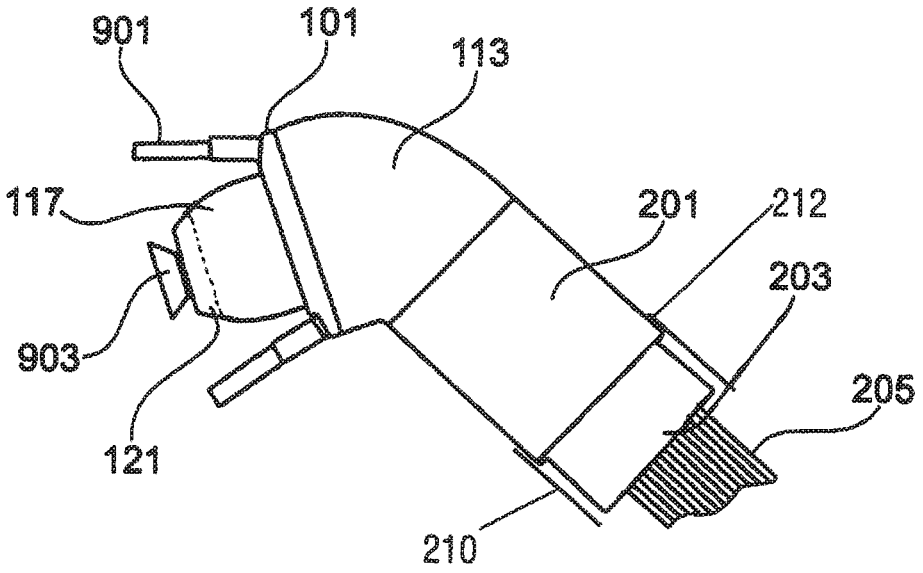
FIG. 9*b* the rotary atomizer from FIG. 9*a* and one further insulating sleeve, according to an exemplary illustration.

FIG. 9*b* is, in the main, identical to FIG. 9*a*, but in particular shows an additional insulating sleeve 210, which can be attached, for example, by means of a thread 212 to the insulating sleeve 201. The additional insulating sleeve 210 can, in particular, be provided in order to cover a receiving device for a fastening means for assembly and disassembly of an atomizer and/or a robot hand axis in an insulating manner.

As can be seen from FIGS. 8, 9*a* and 9*b*, the atomizer housing element 113 and/or the insulating sleeve 201 could also be formed appropriately long in order to cover the receiving device for the fastening means for assembly and disassembly of an atomizer and/or a robot hand axis in an insulating manner. Thus, a one-piece, two-piece or three-piece configuration is possible in order to fulfill the above-mentioned function.

Figure 10A:
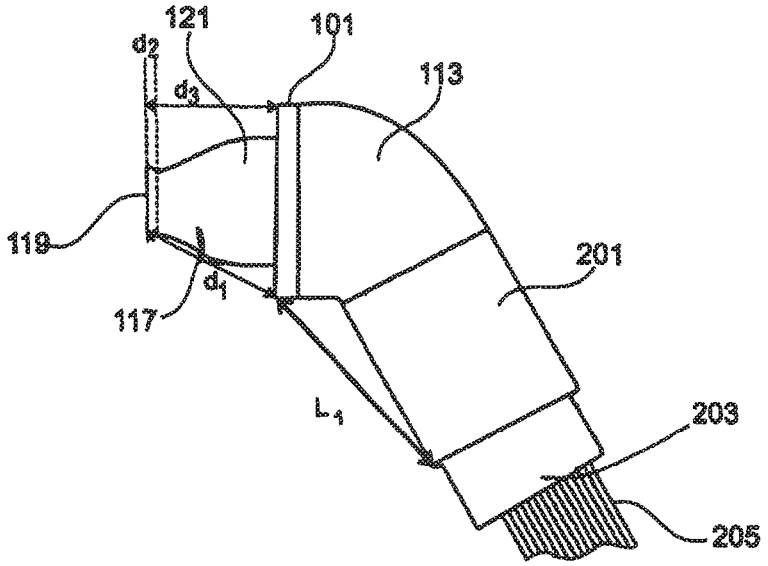
FIG. 10*a* a rotary atomizer according to a further exemplary illustration.

FIG. 10*a* shows an electrostatic atomizer for which the dimensions $d_1$, $d_2$, $d_3$ and $l_1$ shown in FIG. 10*a* can, as described below, be selected in such a way that an advantageous insulation against unwanted discharge currents is made possible and this electrostatic atomizer can be used universally for internal/detail and outer skin painting.

The electrostatic atomizer can, for example, be a high speed rotary atomizer wherein a distance of the electrodes to a bell cup (front) edge $d_1$ can be between 80 and 250 mm air distance, and in one exemplary illustration 140 mm.

A distance of the electrodes to a hand axis or a flange, $l_1$, can lie between 120 to 625 mm wherein, in one exemplary illustration, a shortest air distance can be $l_1$=240 mm (with "extension insulating sleeve"). A ratio $l_1/d_1$ is may in one exemplary illustration be about 2 so that $l_1/d_1=2.0\pm0.5$.

A plurality of bell cup variants may be employed. A bell cup (GT) to be used can be designed free standing, that is a free air distance exists between the electrodes and almost the whole GT. The bell cup can, however, also be covered half by an insulating or partially insulating directing air ring. Full coverage or any other partial coverage is also possible. It may be advantageous that the bell cup is so well covered by an insulating directing air ring, which may be formed out of PEEK or PTFE with the addition of MOS2 (MOS2 (MoS2): molybdenum disulphide) such that no destructive discharges occur between a PTFE housing element, for example a tube, and the directing air ring, that not too much current flows from the electrodes over the bell cup, but that the bell cup is not so strongly covered that the necessary corona discharge cannot fire. In this configuration the bell cup with its edge is an important factor which allows firing of a corona discharge. In this way the bell cup or at least its edge can be conductive, for example metallic, for example made out of titanium. In this way electrons can be generated which accumulate on air molecules and "charge" the atomized paint so that a maximum application efficiency (AWG) is guaranteed. In this sense the bell cup edge represents a "corona firing electrode".

For this configuration all further earthed or insulated edges, in particular edges on the covered support device or on the insulating directing air ring, in the vicinity of the circumferential path between electrodes and the earthed bell cup should be rounded using the largest possible radius.

All or partially earthed components of the atomizer can also be attached to the earthing system over an electrical resistance of <1 MOhm.

In order to achieve the largest possible insulation of the atomizer an air heater can be used, for example in the control air (motor air) or the bearing air of the support device, which apart from its appropriate function to minimize cooling of the expanding motor air by pre-warming, also prevents condensation of ambient or motor air, which can cause one or more unwanted discharge paths, in the area of the bell cup or the directing air ring.

The following dimensions may be selected wherein as standard the bell cup diameter lies in a range between 30 mm and 85 mm, according to an exemplary illustration:

A universally usable bell cup:

Bell cup diameter: $d_{GT_uni}$=60 mm+/−2 mm

Outer jacket form of the bell cup: convex

The convex form is advantageous since it represents a more uncritical counter-potential against the electrodes at the rear in comparison with an inclined outer jacket form, due to a lower field line concentration on the partially round convex surface.

Any bell cup and/or directing air ring may be employed, for example, the bell cup and/or the directing air ring as described in WO 2009/149950 and corresponding U.S. Pat. Pub. No. US 2011/0086166, the contents of each being hereby expressly incorporated herein in their entireties.

Electrode ring diameter: $d_{El.ring}$=220 mm+/−10 mm

Distance of the electrodes to the GT edge (directly in air): $d_1$=140 mm

Distance GT edge to LLR edge (LLR: directing air ring): $d_2$=6 mm to 30 mm, and in one exemplary illustration 12 mm Distance electrodes to GT edge (axially): $d_3$=105 mm to 165 mm, and in one exemplary illustration 118 mm A ratio of the electrode ring diameter to the bell cup diameter may have the following values:

$$\frac{d_{El.ring}}{d_{GT_uni}}(\pm Tol.) = \pi(\pm\pi/4)$$

Furthermore the following interrelation applies with the above values:

$$\frac{d_1 \cdot d_{El.\,ring}}{d^2_{GT_uni}}(\pm Tol.) = 3\pi(\pm\pi)$$

It may be advantageous here that a wall thickness of a directing air ring is maintained of at least 5 mm.

It is possible to connect individual components firmly together, for example to weld or to manufacture them as a whole (in one piece) and to consider them as one component. Thus, for example, the directing air ring 121 together with the housing element 117 or tube can be understood to be "bearing units insulation". Combination of the electrode ring or the electrode assembly 101 with the 60° atomizer housing element 113 can, on the other hand, be designated as a "charging device". Furthermore, combination of the atomizer housing element 113 and the insulating sleeve 201 is possible. Furthermore, the combination of the electrode ring or the electrode assembly 101 with the, for example, 60° atomizer housing element 113 and the insulating sleeve 201 can be advantageously manufactured or designated as a "charging sleeve". Overall it is also possible for all components to be connected together, in particular in a modular fashion and to be considered as an "external charging atomizer".

All surfaces of the atomizer housing and/or the insulating sleeve can (circumferentially) be provided with ribbing, be structured or wavy, in order to (significantly) increase the creepage distances for possible discharge currents. In one exemplary illustration, 3 to 50 ribs can be deployed with a respective height which lies between 1 mm and 20 mm. However, it is also possible to make the above-mentioned surfaces smooth.

Overall a modular construction and/or a construction detachable or demountable by threads or in another manner is intended for all or at least some components, which according to the application in question allows use of respectively adapted components. The charging device, that is the charging and electrode ring, can, for example, be provided with 3 to 60 short or long electrodes or electrode fingers. A special combination of a directing air ring and a bell cup is provided as a universally usable application, wherein external charging with a flexible spray jet is possible so that a small spray jet of between 50-280 mm can be used in internal/detail painting while a large spray jet of between 150-550 mm can be used in external painting. The whole system can also be operated with some slight modifications with air atomizer systems.

It may be advantageous to manufacture the directing air ring or the atomizer part provided with the directing air ring out of insulating material due to insulation measures. The directing air ring can also be made partially insulating and partially conductive for specific dissipation of discharge currents. Also the bell cup can be made insulating or partially insulating if another counter-electrode/ignition electrode serves to fire the necessary corona discharge, for example a conductive or partially conductive directing air ring. In this way it is possible to have a smaller painting distance which may in one example be 150 mm. The smallest possible distance in air of the electrodes to an object or a vehicle body can be up to 10 mm.

The painting distance is reducible to up to 10 mm, in one exemplary illustration 150 mm, through use of the universal bell cup directing air system compared to the standard system. For a 150 mm painting distance there is no larger fouling observed in comparison to the standard system for 200-300 mm.

The setting parameters can be divided in application areas wherein for application under a high voltage the following three possible operating modes can be named:

1) Constant voltage
2) Constant current
3) Constant current and limited voltage

Operating mode 1) may advantageously be used for direct charging, for example for application of solvent-based paints. The voltage is set to a constant value between −40 to −85 kV.

Operating modes 2) and 3) may advantageously be used in external charging, for example for application of water-based paints. Particularly, operating mode 3) can be used for the compact external charging described above.

By the painting by means of external charging in constant current mode (operating modes 2 and 3) the voltage adjusts according to the ambient conditions, for example dependent on a counter-potential, surrounding the electrode tips. The voltage is regulated with a high reaction speed by the resistors in the electrode holding device (101), without causing any sparkovers. In this way it is possible, in an ideal manner, to react to changes in movement, for example closely passing earthed object parts. This is not possible in this way for direct charging (operation at a constant voltage 1).

Since the transferable charge at an electrode finger is low in the range of the ignition energy limit one can dispense with an earthing switch during switching off the high voltage.

For example in the application of insulating plastics parts painting the voltage can be limited to lower value using operating mode 3 or switched off if an earthed article carrier, for example a metal frame behind the edges area of the bumper leads to over-coatings. In the areas where the earthed article carrier does not work or works less, the voltage limitation can be adapted again to higher values.

To minimize fouling or contamination of the atomizer with atomized paint for a base coat application, for example, (without a high voltage), a certain voltage (operating mode 1) and/or a certain current (operating mode 2 or 3) can be specified.

The following parameters can be set for a case of outer skin painting: a constant current I between 200 μA to 500 μA, in one example 400 μA, a voltage U maximally limited to −85 to −100 kV, and, in one exemplary illustration, −90 kV. In this case a total current of 400 μA is distributed, for example, as follows: 60 to 250 μA flows to the object or to the vehicle body, 340 to 150 μA flows to the earthed bell cup or atomizer.

In one exemplary illustration, a ratio current (bell cup)/current (object) is as follows:

$I_{GT}/I_{obj}$=5.7 to 0.6
$I_{GT}/I_{tot}$=85% to 38%
$I_{obj}/I_{tot}$=15% to 62%

In the case of internal/detail painting, a constant current I can be set between 200 μA to 500 μA, and in one example 400 μA, and a voltage U maximally limited to −80 to −100 kV, and in one exemplary illustration −85 kV. In this case a total current of 400 μA is distributed as follows: 40 to 200

μA flows over the paint mist to the object/vehicle body, 360 to 200 μA flows to the earthed bell cup or atomizer.

In one exemplary illustration, a ratio current (bell cup)/current (object) is as follows:

$I_{GT}/I_{obj}$=9.0 to 1.0

$I_{GT}/I_{tot}$=90% to 50%

$I_{obj}/I_{tot}$=10% to 50%

Through this combination and overall due to the compact construction, critical vehicle body parts can be reached well, for example in the door areas, with a best possible painting result.

Figure 10B:
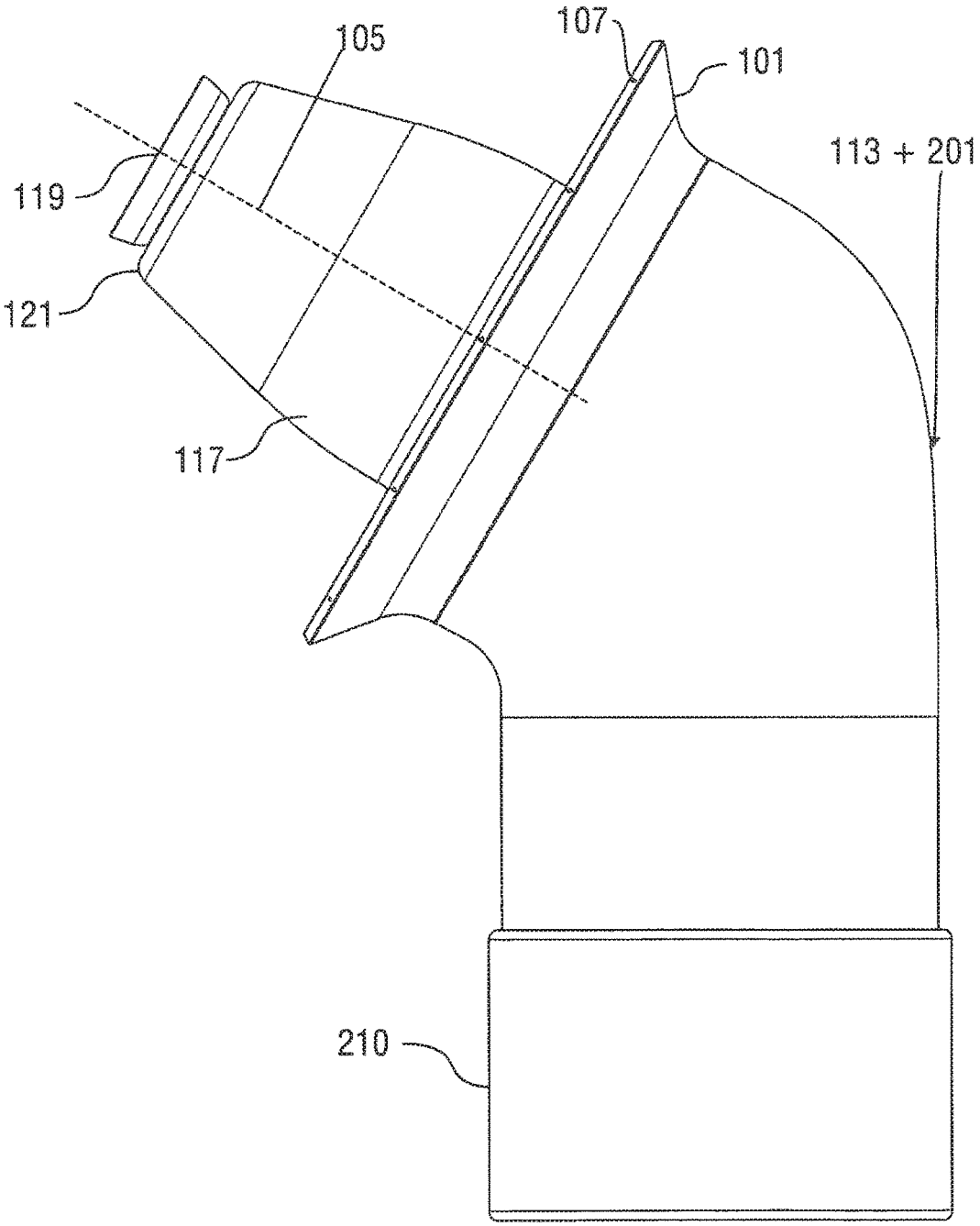
FIG. 10*b* a side view of a rotary atomizer according to a further exemplary illustration.
Figure 10C:
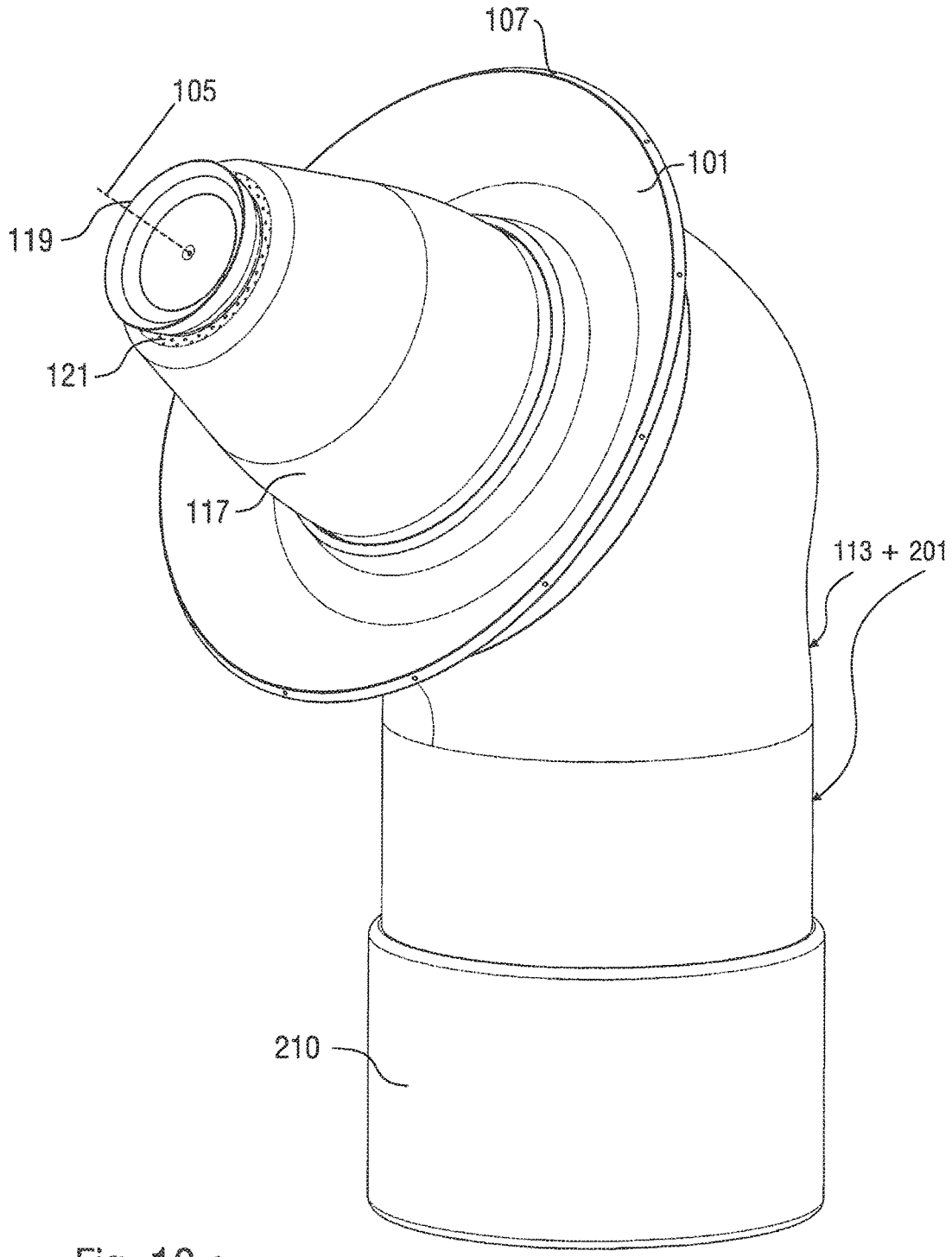
FIG. 10*c* a perspective view of the exemplary rotary atomizer from FIG. 10*b*

FIG. 10*b* shows a side view and FIG. 10*c* a perspective view of an atomizer according to a further example and, in particular, a modified housing element 117 and a modified electrode assembly or electrode holding device 101. Furthermore, FIGS. 10*b*, 10*c* show an atomizer housing element 113 on which an insulating sleeve 201 is detachably attached. Furthermore, there is one further insulating sleeve 210 to be seen detachably attached to the insulating sleeve 201. The additional insulating sleeve 210 is provided in order to cover a robot hand axis and/or a receiving device for a fastening means for assembly or disassembly of an atomizer in an insulating manner. It is also visible from FIGS. 10*b*, 10*c* that it is possible to form the atomizer housing element 113 and/or the insulating sleeve 201 appropriately long in order for it to be suitable for the above-mentioned purpose. Thus an atomizer housing element (in one piece), an atomizer housing element with an detachably attachable insulating sleeve (in two pieces), or an atomizer housing element with an attachable and detachable insulating sleeve on which an additional insulating sleeve is detachably attachable (in three pieces) can be provided as required in order to allow cover a robot hand axis and/or a receiving device for a fastening means for assembly and disassembly of an atomizer in an insulating manner.

The electrode assembly and the electrode holding device 101, respectively is formed substantially ring-shaped around an axis of symmetry 105 and arranged substantially coaxially to the axis of symmetry 105.

The electrode assembly comprises a substantially ring-shaped section and the electrode holding device 101 (an expanding section) which is formed particularly substantially conically expanding and/or protruding obliquely to the (radial) outside and to the (axial) front (or in direction of the spray element/bell cup 119 or to the side of the spray element/bell cup 119). The electrodes or electrode receiving spaces 107 are housed in the expanding electrode holding device 101 and thus also extend obliquely to the outside and to the front.

The substantially ring-shaped section comprises a thread which is connected to a thread of the atomizer housing element 113. The ring-shaped section and the thread of the electrode assembly cannot be seen in FIGS. 10*b*, 10*c* since they are covered by the atomizer housing element 113.

In FIGS. 10*b*, 10*c* one can also see a directing air ring 121 which is integrated into the housing element 117. In this case the housing element 117 is the atomizer part provided with the directing air ring 121.

Figure 10D:
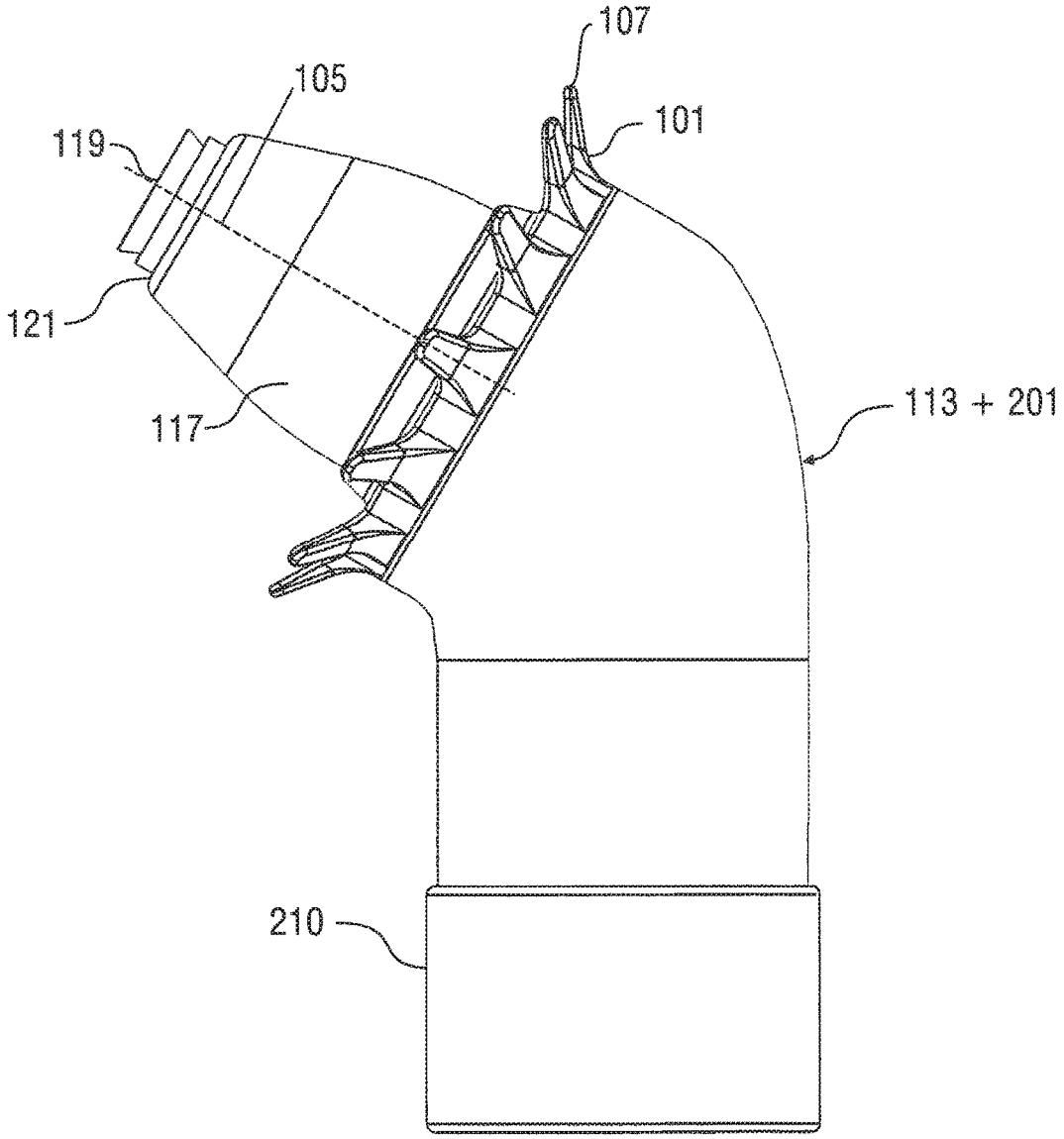
FIG. 10*d* a side view of a rotary atomizer according to a further exemplary illustration.

FIG. 10*d* shows an atomizer which, with the exception of the electrode assembly is identical to the atomizer in FIGS. 10*b*, 10*c*. The expanding electrode holding device 101 shown in FIGS. 10*b*, 10*c* is provided as a single expanding section, whereas the electrode holding device 101 shown in FIG. 10*d* has a plurality of discontinuities and therefore comprises a plurality of sections or consists of a plurality of sections which respectively project outwards and/or to the front, evenly spaced apart from each other in the direction of the circumference. Every single section of the expanding electrode holding device 101 from FIG. 10*d* comprises an electrode or an electrode receiving space 107 and tapers towards its free end. The electrodes in the atomizer according to FIG. 10*d* may be arranged identical to the electrodes of the atomizer according to FIGS. 10*b* and 10*c*.

Figure 11A:
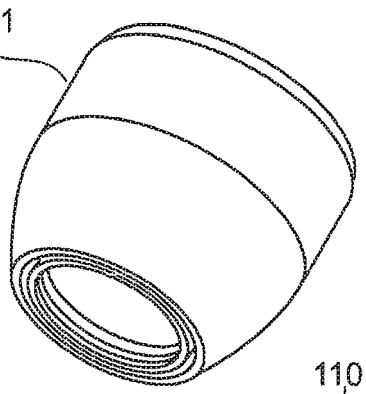
FIGS. 11*a*-11*b* views of a housing element, according to an exemplary illustration.
Figure 11B:
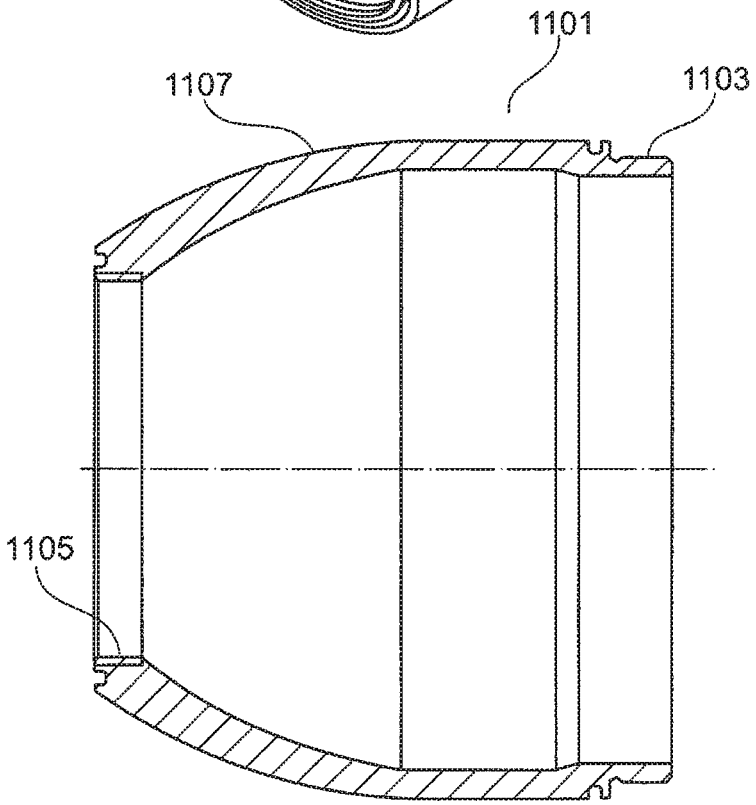

FIGS. 11*a*-11*b* show various views of a housing element 1101 which corresponds to the housing element 117 shown in FIG. 1. The housing element comprises a thread 1103 for screwing with an atomizer housing element, for example the atomizer housing element 113 from FIG. 1. The thread can, for example, be an M110×2 thread with a thread length of at least 9 mm, and, in one exemplary illustration, 20 mm. This thread can, for example, be greased with an insulating medium, for example insulating grease, such as vaseline, and forms a labyrinth for possible discharge paths with the thread 1103. There is furthermore provided an additional thread 1105 for screwing with a directing air ring, for example the directing air ring 121 from FIG. 1. The thread can, for example, be a M65×2 thread with a thread length of at least 9 mm. The housing element 1101 is, for example, formed as a tube and has a surface 1107 which can be smooth or wavy in order to achieve the insulating effect described above. The larger the surface 1107 the greater the creepage distances for a discharge current from electrode tips with a high voltage applied to them to the front, for example, an earthed spray element 119, for example a bell cup, or a turbine. The housing element can, for example, be formed out of an insulating material, for example, PTFE, and be provided to cover the earthed bearing unit arranged, for example, below it in an insulating manner. In order to reduce weight it is also possible to use a foam material, for example a grid-type crosslinking or multi-ply layers, wherein the insulation corresponds, for example, to that of a solid material. The housing element can have a thickness of between 1 mm and 15 mm for a length of, for example, 140 mm or in the range of 85 mm to 185 mm. It is also possible on the housing element 1101 to have an insulating plastic directing air ring integrated made, for example, from a mixture of PTFE and MoS2 which can be screwed on or firmly attached, for example welded on, glued on or sintered in.

The parts shown in FIGS. 1-12*g* (for example the electrode assembly, the housing element, the atomizer housing element and/or the insulating sleeve) can have the dimensional relationships shown in the figures.

Furthermore, the exemplary sizes, dimensions, distances, ratios, etc. explained with reference to FIG. 10*a* can also apply for the exemplary illustrations shown in FIGS. 10*b*, 10*c* and 10*d*.

Figures 12A, 12B, 12C, 12D, 12E, 12F, 12G:
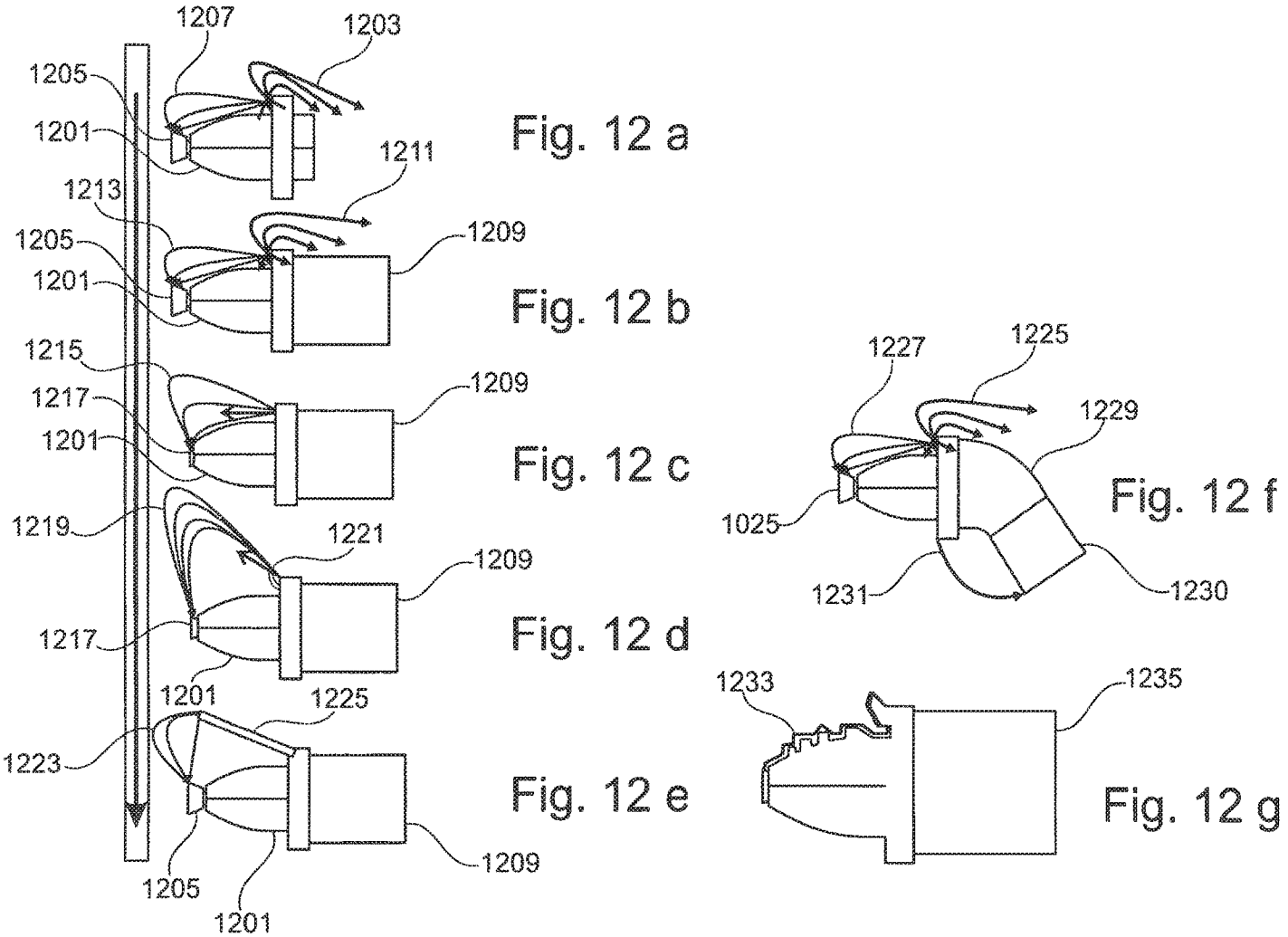
FIGS. 12*a*-12*g* example field distributions.

In FIGS. 12*a* to 12*g* there are example field distributions shown which show the desired current flow from the electrode tips (high voltage) to earthed elements such as for example to the bell cup or a hand axis or the same taking the example of a rotary atomizer 1201. Here, current flow over the respective object can be increased by the screening measures. In FIG. 12*a* the rearward discharge currents 1203 are stronger than the discharge currents 1207 directed towards a bell cup 1205.

As shown in FIG. 12*b*, it is possible, through use of an insulating sleeve 1209, that the rearward discharge currents 1211 are weakened compared to the forward directed discharge currents 1203 to the bell cup. The insulation to the inside and to the rear can be realized through the choice of construction material, by a material thickness, by a length of the insulating sleeve 1209, by a thread which can be provided with an insulating medium such as vaseline or by other production processes.

As shown in FIG. 12*c*, a change in the field lines concentration or the discharge currents 1215 to the front onto an edge of the bell cup 1217 can be effected by covering of the same.

As shown in FIG. 12*d*, a change in the field lines concentration or the discharge currents 1219 to the bell cup can be effected by different angles of electrodes 1221 or by covered electrodes 1221.

As shown in FIG. 12*e*, a field lines concentration 1223 can be effected by a modular structure of an electrode 1225 for various application cases, for example for the outer skin respectively the internal painting.

As shown in FIG. 12*f*, a concentration of the rearward discharge currents 1225 as well as the discharge currents 1227 directed towards the bell cup can be effected by, for example, a 60° angled atomizer housing element 1229, which can be insulated, in particular for internal painting. An insulating sleeve 1230 connected with the atomizer housing element 1229 causes influencing of a discharge current component 1231 extending in the direction of the hand axis of the atomizer.

In FIG. 12*g* there is an example extension of a creepage current path 1233 shown which establishes a propagation path for a discharge current component by a sleeve 1235 or its thread.

The external charging concept described above allows a compact and modular construction of rotary atomizers and is therefore, in particular, suitable for vehicle body internal painting, for attachment part painting, for outer skin painting and/or for internal painting. Furthermore, this makes it possible to manufacture rotary atomizers which can be cleaned in a compact atomizer cleaning device.

The already described use of an air heater, for example, in the control air (motor air) or the bearing air of the support device also allows a more rapid drying after use of the atomizer cleaning device.

Furthermore, an application of water-based paints in internal or detail painting without extensive potential separation using the same system as is used for the outer skin painting is made possible, which means a simple construction and low maintenance requirement. Furthermore, comparable paint application efficiencies or paint layer thicknesses can be achieved compared to standard systems both in internal painting or detail painting as well as in outer skin painting. Furthermore, it is possible to achieve low atomizer fouling, good cleaning options, use of compact atomizer cleaning devices.

While complying with certain safety aspects it is possible, by using the above-mentioned electrostatic atomizer under a high voltage, to not only apply heavy or non-inflammable paints (those in the previous category yellow or green) as, for example, water-based paints, but also inflammable paints (those in the previous category red) like, for example, low-resistance solvent-based paints, in particular with a high solids content. Here both internal painting as well as external painting with low-resistance paints can be performed in an advantageous way using the same atomizer.

It is advantageously further possible to avoid sparkovers, for example between a bell cup edge and the vehicle body or the paint object according to the construction type both in internal painting as well as in external painting, so that coating of vehicle body cavities or tight, sharp edges is possible using higher voltages than in direct charging. It is furthermore possible to have painting with or without a high voltage wherein both vehicle body painting as well as small part painting in both low and high piece numbers can be realized, whereby a higher degree of flexibility and higher levels of safety can be achieved.

Between the electrical conductivity of a paint and the application efficiency there is a connection in a certain range which states: the higher the electrical conductivity or the lower the resistance of a paint the higher the application efficiency.

The greatest potential for an increase can be observed in the area of solvent-based paints (some 100 kOhm Ransburg resistance). Increasing the electrical conductivity of a solvent-based paint to some kOhms leads to an increase in the application efficiency. However, operation using conventional direct charging technology is no longer possible without problems or without having to make compromises. It would be necessary to resort to expensive and extensive potential separation systems. Application of these paints using the above-mentioned atomizer (compact external charging) represents a significantly more favorable variant for a comparable result concerning application efficiency.

For example, for painting of plastic attachment parts with an extremely low resistance clear solvent-based paint the above-mentioned atomizer is particularly advantageous to use, also for vehicle body painting, both in internal painting as well as in outer skin painting.

Furthermore, use, for example, of an extremely low resistance clear solvent-based paint is even an advantage in painting plastic attachment parts. The already applied filler and base coat layers or the substrate can generally be insulated electrically so that use of a good conductive clear solvent-based paint again ensures connection to the earth and therefore good application efficiency.

The exemplary illustrations also comprise the insight that positioning-monitoring/detection/determination of an object to be painted and/or the atomizer, in particular the electrode assembly, can be achieved by evaluation of the current (I) and/or the voltage (U). It may be advantageous that the relative position between the atomizer and the object to be painted can be monitored, detected and/or determined.

If, for example, the electrode ring or the electrode assembly comes into the vicinity of an earthed object then the voltage will be regulated downwards for a predetermined current in operating mode 2 or 3 (I-constant, U limited). This behavior can be used to determine the distance between the electrode ring and the earthed object and to draw conclusions about the position of the object to be painted relative to the atomizer.

In internal painting of vehicle bodies it is possible to determine, for example, the position of a door or an engine hood to be painted or at least the information: object positioned—Yes or No.

A possible exemplary illustration provides for the values of the actual current I and the actual voltage U to be detected or recorded. The evaluation can take place differentially as dI/dt and dU/dt, respectively in order to computationally eliminate changing ambient conditions (temperature, air humidity, etc.) or the atomizer fouling or already coated layers on the object to be painted which have an influence on the current and voltage values, respectively.

Design variant 1: To calibrate the system one or more "master positions" (recording of the distances of electrode tips to the object) can be defined for every atomizer in a clean condition:

Recording of the absolute values of current I and voltage U for defined distances x and creation of relative values dI(x)/dt and dU(x)/dt, respectively.

Example: The robot moves at a constant speed (200 mm/s) along a distance 200 mm long directly in the direction of the object, the distance of electrode tips to the object x=250 mm. U and I are recorded every 20 mm. The time interval dt=100 ms→ Calculation of dI(x)/dt and dU(x)/dt), respectively.

During production (a painting cycle) the absolute values of the actual current I and the actual voltage U can be compared for these "master positions" in order to possibly establish deviations. For example, in the case of excessively large deviations (with a tendency towards lower voltage values) in the actual current and voltage values, the necessity for a compulsory atomizer cleaning can be recognized and be initiated, respectively.

Design variant 2: Since the voltage does not depend linearly on the distance and the geometry of the object and the position of the electrode ring to the object enter the relation, too it is possible to store a theoretical approximation curve with parameters. These parameters can then be adapted individually for the respective object using software. A different approximation curve with appropriate parameters can be stored for every altered object to be painted (for example a door, an engine hood, etc.) or created new once. Adaptation of the theoretical approximation curve to the reality takes place, for example, once during measurement of U and I for various defined distances x from the object to be painted (see Design variant 1).

Design variants 1 and 2 can be combined for redundant position monitoring but also utilized individually.

Determination of the position of an object to be painted can take place over a defined movement of the atomizer (electrode rings) in the direction of the object (e.g. a door or an engine hood etc.). Through calculation of the values dU/dt and dI/dt, respectively it is possible to make a statement based on comparison with the master positions x about whether the object to be painted is correctly positioned within a tolerance range or not.

The exemplary illustrations are not limited to the previously described example. Rather, a plurality of variants and modifications are possible, which also make use of the ideas of the exemplary illustrations and therefore fall within the protective scope. Furthermore, the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. An electrode assembly for an electrostatic atomizer, the atomizer having an axis of symmetry and having a first housing and a second housing and an electrode holding area established by a difference in diameter between the first and second housings, the electrode holding area including a first thread, the electrode assembly comprising:

an annular electrode holding device, configured to fit around at least the first housing and for holding a plurality of electrodes that generate an electrostatic field, the electrode holding device including a second thread that engages with the thread of the electrode holding area to threadedly connect the electrode holding device to the first housing, wherein the first and second threads are coaxial to the axis of symmetry and form a labyrinth and the labyrinth is defined by a dielectric material and is configured to extend a discharge current path in a direction of the axis of symmetry.

2. Electrode assembly according to claim 1, wherein an angle between the electrode and the axis of symmetry is greater than 40° and less than 70°.

3. Electrode assembly according to claim 1, wherein the first and second threads are formed from the dielectric material.

4. Electrode assembly according to claim 1, further comprising at least one screen for forming the labyrinth, wherein the at least one screen is spaced from a resistor located in a connection area, wherein the resistor is concentric with the at least one screen and wherein the resistor is located between portions of the at least one screen.

5. Electrode assembly according to claim 4, wherein the screen is formed from the dielectric material.

6. Electrode assembly according to claim 1, wherein the dielectric material is provided for influencing a discharge current component of a discharge current extending in the direction of the axis of symmetry and wherein the electrode holding device is provided for holding the at least one electrode around the axis of symmetry.

7. An electrode assembly according to claim 1, with at least one electrode which can be coupled with the electrode holding device to generate the electrostatic field, wherein the at least one electrode is contained entirely within the electrode holding device.

8. Electrode assembly according to claim 1, wherein in at least one of the electrode holding device, an insulating material of the electrode holding device, and the dielectric material, at least one resistor is provided for preventing voltage flashovers.

9. Electrode assembly according to claim 1, wherein the dielectric material is formed collarly projecting and the at least one electrode is encased by the dielectric material.

10. Electrode assembly according to claim 1, wherein the dielectric material is provided to influence a further discharge current component opposed to the discharge current component less than the discharge current component.

11. Electrode assembly according claim 1, with:

a plurality of electrodes which are arranged around the axis of symmetry and coupled with the electrode holding device, wherein the ends of the plurality of electrodes facing away from the electrode holding device are arranged along a circular path.

12. Electrode assembly according to claim 11, wherein a ratio of a radius of the circular path to at least one of a radius of a cross-section of a spray element of the electrostatic atomizer and a radius of a cross-section of the electrode holding device is predetermined and lies within a ratio range between 2:1 and 4:1.

13. Electrode assembly according to claim 11, wherein a ratio of a product of a radius of the circular path and a distance of the circular path to a spray element of the electrostatic atomizer to a squared diameter of the component lies in a range between 2 II and 4 II.

14. Electrode assembly according to claim 4, wherein the screens are arranged coaxially to the axis of symmetry.

15. Electrode assembly according to claim 1, wherein the first and second threads are provided with an insulation medium.

16. Electrode assembly according to claim 1, wherein the electrode holding device has a first electrical connection for contacting at least one electrode and wherein the electrode assembly has a second electrical connection for contacting the first electrical connection, wherein the second electrical connection is led to the outside.

17. Electrode assembly according to claim 1, with external charging allowing both internal and external coating of workpieces.

18. Electrode assembly according to claim 1, wherein the angle between the electrode and the axis of symmetry is 55 degrees.

* * * * *